US011129511B2

(12) United States Patent
Choi et al.

(10) Patent No.: US 11,129,511 B2
(45) Date of Patent: Sep. 28, 2021

(54) VACUUM CLEANER

(71) Applicant: Samsung Electronics Co., Ltd., Suwon-si (KR)

(72) Inventors: Keon Soo Choi, Gwangju (KR); Shin Kim, Hwaseong-si (KR); Dong Hyun Lee, Suwon-si (KR); Dong Woo Ha, Hwaseong-si (KR); Chang Hyun Lee, Suwon-si (KR); Ji Yeon Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 442 days.

(21) Appl. No.: 15/024,210

(22) PCT Filed: Sep. 23, 2014

(86) PCT No.: PCT/KR2014/008826
§ 371 (c)(1),
(2) Date: Mar. 23, 2016

(87) PCT Pub. No.: WO2015/041499
PCT Pub. Date: Mar. 26, 2015

(65) Prior Publication Data

US 2016/0235268 A1 Aug. 18, 2016

Related U.S. Application Data

(60) Provisional application No. 61/982,534, filed on Apr. 22, 2014.

(30) Foreign Application Priority Data

Sep. 23, 2013 (KR) ..... 10-2013-0112737
Sep. 19, 2014 (KR) ..... 10-2014-0124969

(51) Int. Cl.
*A47L 9/28* (2006.01)
*A47L 9/00* (2006.01)
(Continued)

(52) U.S. Cl.
CPC ..... *A47L 9/2805* (2013.01); *A47L 9/009* (2013.01); *A47L 9/1683* (2013.01);
(Continued)

(58) Field of Classification Search
CPC .... A47L 9/2805; A47L 9/2852; A47L 9/2836; A47L 9/009; Y10T 74/19614;
(Continued)

(56) References Cited

U.S. PATENT DOCUMENTS 4,601,082 A * 7/1986 Kurz ..... A47L 9/2815 15/319
5,109,566 A * 5/1992 Kobayashi ..... A47L 11/4011 15/319
(Continued)

FOREIGN PATENT DOCUMENTS

CN 1164379 11/1997
CN 2321378 6/1999
(Continued)

OTHER PUBLICATIONS

Extended European Search Report dated Mar. 30, 2017 in corresponding European Patent Application No. 14846308.6.
(Continued)

*Primary Examiner* — Orlando E Aviles
*Assistant Examiner* — Joel D Crandall
(74) *Attorney, Agent, or Firm* — Staas & Halsey LLP

(57) ABSTRACT

A vacuum cleaner includes an actuator connected to a suction hose to rotate in left and right directions centering on a first rotation axis, or in forward and backward directions centering on a second rotation axis according to movement
(Continued)

of the suction hose, a first displacement sensor detecting rotational displacement of the actuator in the left and right directions, and a second displacement sensor detecting rotational displacement of the actuator in the forward and backward directions, and controls activation of a plurality of driving motors according to the rotational displacement of the actuator in the left and right directions and in the forward and backward directions, which are detected by the first displacement sensor and the second displacement sensor, thereby advancing or rotating the main body in the left and right directions.

18 Claims, 19 Drawing Sheets

(51) Int. Cl.
*A47L 9/32* (2006.01)
*A47L 9/16* (2006.01)

(52) U.S. Cl.
CPC ..... *A47L 9/2852* (2013.01); *A47L 9/2857* (2013.01); *A47L 9/2863* (2013.01); *A47L 9/32* (2013.01)

(58) Field of Classification Search
CPC ..... G05G 15/007; G05G 15/02; G05G 15/04; G05G 15/08; G05G 2009/047; G05G 2009/04711; G05G 2009/04714; G05G 2009/04718; G05G 2009/04748
See application file for complete search history.

(56) References Cited

U.S. PATENT DOCUMENTS 5,619,195 A * 4/1997 Allen ..... G05G 9/047 200/6 R
6,226,830 B1 * 5/2001 Hendriks ..... A47L 5/36 15/319
6,573,885 B1 * 6/2003 McVicar ..... F16D 3/382 345/156
6,581,549 B2 * 6/2003 Stewart ..... F28G 1/16 122/379
9,134,187 B1 * 9/2015 Organ ..... G05G 9/047
2002/0138936 A1 * 10/2002 Takeuchi ..... A47L 9/009 15/319
2008/0184520 A1 * 8/2008 Wolfe ..... A47L 7/0009 15/340.1
2009/0038107 A1 * 2/2009 Tiekoetter ..... A47L 5/362 15/339
2010/0132149 A1 * 6/2010 Jeong ..... A47L 5/362 15/319
2013/0212829 A1 * 8/2013 Yoon ..... A47L 5/36 15/319
2015/0331424 A1 * 11/2015 Noh ..... G05D 1/0231 701/28

FOREIGN PATENT DOCUMENTS

| | | | |
|---|---|---|---|
| CN | 2455189 | | 10/2001 |
| CN | 1575742 | | 2/2005 |
| DE | 102012101589 | A1 | 8/2013 |
| EP | 2420170 | | 2/2012 |
| EP | 2630903 | A2 | 8/2013 |
| JP | 2-26522 | | 1/1990 |
| JP | 8-17759 | | 2/1996 |
| JP | 9-503398 | | 4/1997 |
| KR | 10-1996-0037005 | | 11/1996 |
| KR | 10-2007-0102849 | | 10/2007 |
| KR | 10-2008-0098736 | | 11/2008 |
| KR | 10-2013-0096047 | | 8/2013 |
| WO | 2008/117945 | A1 | 10/2008 |
| WO | 2008/136575 | A1 | 11/2008 |

OTHER PUBLICATIONS

Chinese Office Action dated Jan. 10, 2018 in Chinese Patent Application No. 201480052246.1.
Chinese Notice of Allowance dated Jul. 2, 2018 in Chinese Patent Application No. 201480052246.1.
International Search Report and Written Opinion of the International Searching Authority dated Dec. 22, 2014 in International Patent Application No. PCT/KR2014/008826.
Indian Office Action dated Apr. 3, 2019 in Indian Patent Application No. 201617012323.
European Communication under Rule 71(3) EPC dated Apr. 6, 2021 in European Patent Application No. 14846308.6.
Korean Office Action dated Feb. 10, 2021 in Korean Patent Application No. 10-2014-0124969.
Korean Notice of Allowance dated Apr. 9, 2021 in Korean Patent Application No. 10-2014-0124969.
Korean Office Action dated Nov. 10, 2020 in Korean Patent Application No. 10-2014-0124969.

* cited by examiner

VACUUM CLEANER

CROSS-REFERENCE TO RELATED APPLICATIONS

This application claims the priority benefit of PCT/KR2014/008826 filed Sep. 23, 2014 in the Korean Intellectual Property Office, which claims the priority benefit of Korean Patent Application No. 10-2013-0112737 filed on Sep. 23, 2013 in the Korean Intellectual Property Office, Korean Patent Application No. 10-2014-0124969 filed on Sep. 19, 2014 in the Korean Intellectual Property Office, and U.S. Provisional Application 61/982,534 filed in the U.S. Patent and Trademark Office on Apr. 22, 2014, the disclosures of which are incorporated herein in its entirety by reference.

TECHNICAL FIELD

The present invention relates to an active driving vacuum cleaner.

BACKGROUND ART

A vacuum cleaner is a household electric appliance, which is generally provided with a fan motor for generating a suction force to suck in air from a surface being cleaned and a dust collector to separate dust from the air being sucked therein, thereby performing a cleaning operation.

A type of such a vacuum cleaner may include a canister type, an upright type, a hand type, a robot type, and the like.

In particular, the canister type vacuum cleaner may be equipped with a main body having a fan motor and a dust collector, a suction nozzle for sucking in air from a surface being cleaned, a handle tube for adjusting a position of the suction nozzle, an extension tube for connecting the suction nozzle to the handle tube, a suction hose for connecting the handle tube to the main body, and the like, and thus a user may perform a cleaning while holding the handle tube to adjust a position of the suction nozzle, and then the air sucked in through the suction nozzle is passed through sequentially the extension tube, the handle tube, and the suction hose to be delivered to the main body.

Such a canister type vacuum cleaner may be equipped with an active driving structure in which the main body actively travels according to a position of the handle tube. An active driving structure in the related art may include ultrasonic sensors provided at a handle tube and a main body, respectively, and a driving motor for providing wheels with a driving force, and measure a distance between the handle tube and the main body to activate the driving motor and advance the main body when the distance between the handle tube and the main body becomes equal to or greater than a predetermined distance.

Because such an active driving structure is on the basis of distances having only physical quantities without directional properties, movement of the handle tube may be not accurately applied to the active driving. In other words, when the handle tube moves in a left or right direction instead of moving forward, the main body does not rotate in a direction to which the handle tube moves.

Also, the driving motor and reduction gears, which are connected to the wheels, serve as loads obstructing idle rotation of the wheels in a situation that the active driving is not required. In other words, when the user moves manually the main body after cleaning and turning off the power, the wheels are not rotated smoothly to cause inconvenience for the user.

DISCLOSURE

Technical Problem

One aspect of the present invention discloses a vacuum cleaner having an active driving structure capable of rotating in a left or right direction as well as moving a main body in a forward direction according to movement of a suction hose.

Another aspect of the present invention discloses a vacuum cleaner having an active driving structure capable of measuring movement in forward and backward directions of a suction hose and in right and left directions thereof through a displacement sensor.

Still another aspect of the present invention discloses a vacuum cleaner having an active driving structure capable of disconnecting wheels and a driving motor when the power or an active driving mode is turned off, to smoothly and idly rotate the wheels owing to friction between a bottom surface and the wheels.

Yet another aspect of the present invention discloses an upright type cleaner capable of performing active driving on the basis of a relative rotational displacement of a handle unit with respect to a main body.

Technical Solution

According to one aspect of the spirit of the present invention, a vacuum cleaner includes a main body; a suction nozzle configured to suck in air from a surface being cleaned; a suction hose configured to guide the air sucked in through the suction nozzle to the main body; a plurality of wheels provided at both sides of the main body; a plurality of driving motors configured to provide the plurality of wheels with driving forces; an actuator connected to the suction hose to rotate in left and right directions centering on a first rotation axis or in forward and backward directions centering on a second rotation axis according to movement of the suction hose; a first displacement sensor configured to detect rotational displacement of the actuator in the left and right directions; a second displacement sensor configured to detect rotational displacement of the actuator in the forward and backward directions; and a control unit configured to control activation of the plurality of driving motors according to the rotational displacement of the actuator in the left and right directions and in the forward and backward directions, which are detected by the first displacement sensor and the second displacement sensor, thereby advancing or rotating the main body in the left and right directions.

Here, the actuator may include a first rotating body provided to be relatively rotatable with respect to the main body in the left and right directions centering on the first rotation axis, and a second rotating body coupled to the first rotating body to be relatively rotatable with respect to the first rotating body in the forward and backward directions centering on the second rotation axis and connected to the suction hose.

Here, the vacuum cleaner may further include a supporting body fixed to the main body to support the first rotating body, and the first rotating body may be coupled to the supporting body to be relatively rotatable with respect to the supporting body in the left and right directions centering on the first rotation axis.

Here, the first displacement sensor may be a potentiometer having a first sensor body and a first adjustment knob provided rotatably on the first sensor body to change resistance.

Here, the first sensor body may be coupled to the supporting body, and the first adjustment knob may be inserted into the first rotating body to be rotated together therewith.

Also, the second displacement sensor may be a potentiometer having a second sensor body and a second adjustment knob provided rotatably on the second sensor body to change resistance.

Here, the second sensor body may be coupled to the first rotating body, and the second adjustment knob may be inserted into the second rotating body to be rotated together therewith.

Further, the vacuum cleaner may further include at least one elastic member for elastically supporting the actuator.

Furthermore, the vacuum cleaner may further include an inner hose provided inside the actuator to communicate with the suction hose.

Alternatively, the vacuum cleaner may further include a vent unit provided inside the actuator to communicate with the suction hose.

Here, the vent unit may include a first vent coupled to a lower portion of the second rotating body to communicate with the suction hose, and a second vent coupled rotatably to the first vent by a universal joint to communicate with the first vent.

Here, the second vent may include a bowl unit having an outer circumferential surface of a spherical shape, and the first vent may include a bowl housing configured to surround and support the bowl unit.

Meanwhile, the actuator may be provided at an upper portion of the main body.

Here, a rotational displacement of the actuator may occur in the forward direction when the suction hose is pulled in the forward direction of the main body, a rotational displacement of the actuator may occur in the left direction when the suction hose is pulled in the left direction of the main body, and a rotational displacement of the actuator may occur in the right direction when the suction hose is pulled in the right direction of the main body.

Here, the plurality of driving motors may be activated to move the main body in the forward direction when the rotational displacement of the actuator occurs in the forward direction, a right driving motor of the plurality of driving motors may be activated to rotate the main body in the left direction when the rotational displacement of the actuator occurs in the left direction, and a left driving motor of the plurality of driving motors may be activated to rotate the main body in the right direction when the rotational displacement of the actuator occurs in the right direction.

Alternatively, the actuator may be provided at a front portion of the main body.

Here, a rotational displacement of the actuator may occur in the backward direction when the suction hose is pulled in the forward direction of the main body, a rotational displacement of the actuator may occur in the left direction when the suction hose is pulled in the left direction of the main body, and a rotational displacement of the actuator may occur in the right direction when the suction hose is pulled in the right direction of the main body.

Here, the plurality of driving motors may be activated to move the main body in the forward direction when the rotational displacement of the actuator occurs in the backward direction, a right driving motor of the plurality of driving motors may be activated to rotate the main body in the left direction when the rotational displacement of the actuator occurs in the left direction, and a left driving motor of the plurality of driving motors may be activated to rotate the main body in the right direction when the rotational displacement of the actuator occurs in the right direction.

Also, the vacuum cleaner may further include a plurality of reduction gears configured to deliver the driving forces of the plurality of driving motors to the plurality of wheels; and multiple clutches configured to intermit power transmission by connecting or disconnecting the plurality of reduction gears and the plurality of wheels.

Here, the multiple clutches may be made of an electronic type or a mechanical type.

According to another aspect of the spirit of the present invention, a vacuum cleaner includes a main body; a plurality of wheels provided at both sides of the main body; a plurality of driving motors configured to provide the plurality of wheels with driving forces; an actuator configured to rotate in left and right directions centering on a first rotation axis or in forward and backward directions centering on a second rotation axis; a first displacement sensor configured to detect rotational displacement of the actuator in the left and right directions; a second displacement sensor configured to detect rotational displacement of the actuator in the forward and backward directions; and a control unit configured to control activation of the plurality of driving motors according to the rotational displacement of the actuator in the left and right directions and in the forward and backward directions, which are detected by the first displacement sensor and the second displacement sensor, thereby advancing or rotating the main body in the left and right directions.

According to still another aspect of the spirit of the present invention, a vacuum cleaner includes a main body; a plurality of wheels provided at both sides of the main body; a plurality of driving motors configured to provide the plurality of wheels with driving forces; a plurality of reduction gears configured to deliver the driving forces of the plurality of driving motors to the plurality of wheels; an actuator configured to rotate in left and right directions centering on a first rotation axis or in forward and backward directions centering on a second rotation axis; a first displacement sensor configured to detect rotational displacement of the actuator in the left and right directions; a second displacement sensor configured to detect rotational displacement of the actuator in the forward and backward directions; and multiple clutches configured to intermit power transmission by connecting or disconnecting the plurality of reduction gears and the plurality of wheels, and may have an active driving mode in which the multiple clutches are connected and a manual driving mode in which the multiple clutches are disconnected.

Here, the plurality of driving motors may be activated according to rotation of the actuator to enable the main body to actively advance or rotate in the left and right directions in the active driving mode.

Further, the plurality of wheels may idly rotate without interfering with loads of the plurality of driving motors and the plurality of reduction gears in the manual driving mode.

According to yet another aspect of the spirit of the present invention, a vacuum cleaner includes a main body configured to generate a suction force and to separate dust from air being sucked in; a suction nozzle unit provided at a lower portion of the main body to suck in air from a surface being cleaned; a driving unit having a plurality of wheels and configured to drive the main body; a handle unit provided at an upper portion of the main body to be relatively rotatable with respect to the main body; and a control unit configured to control the driving unit on the basis of a relative rotational displacement of the handle unit with respect to the main body to enable the main body to perform active driving.

The handle unit may be provided to rotate with respect to the main body centering on at least one rotation axis.

The handle unit may be provided to rotate with respect to the main body centering on multiple rotation axes which are perpendicular to each other.

The vacuum cleaner may further include an actuator provided between the main body and the handle unit to relatively rotatably couple the main body to the handle unit.

The vacuum cleaner may further include a displacement sensor configured to detect a relative rotational displacement of the handle unit with respect to the main body.

Advantageous Effects

In accordance with the spirit of the present invention, a main body of a vacuum cleaner is capable of performing active driving in which the main body is rotated in a left or right direction as well as advanced according to a pulling motion of a suction hose by a user.

A rotational displacement of an actuator according to the pulling motion of the suction hose by the user may be measured through multiple displacement sensors.

When the power or active driving mode of the vacuum cleaner is turned off, a driving motor and reduction gears are disconnected from wheels and then do not serve as loads to enable the wheels to be rotated manually and smoothly.

The vacuum cleaner is possible to perform the active driving on the basis of a relative rotational displacement of a handle unit with respect to the main body, thereby improving convenience for the user.

MODES OF THE INVENTION

Hereinafter, preferred embodiments according to the present invention will be described in detail.

Figure 1:
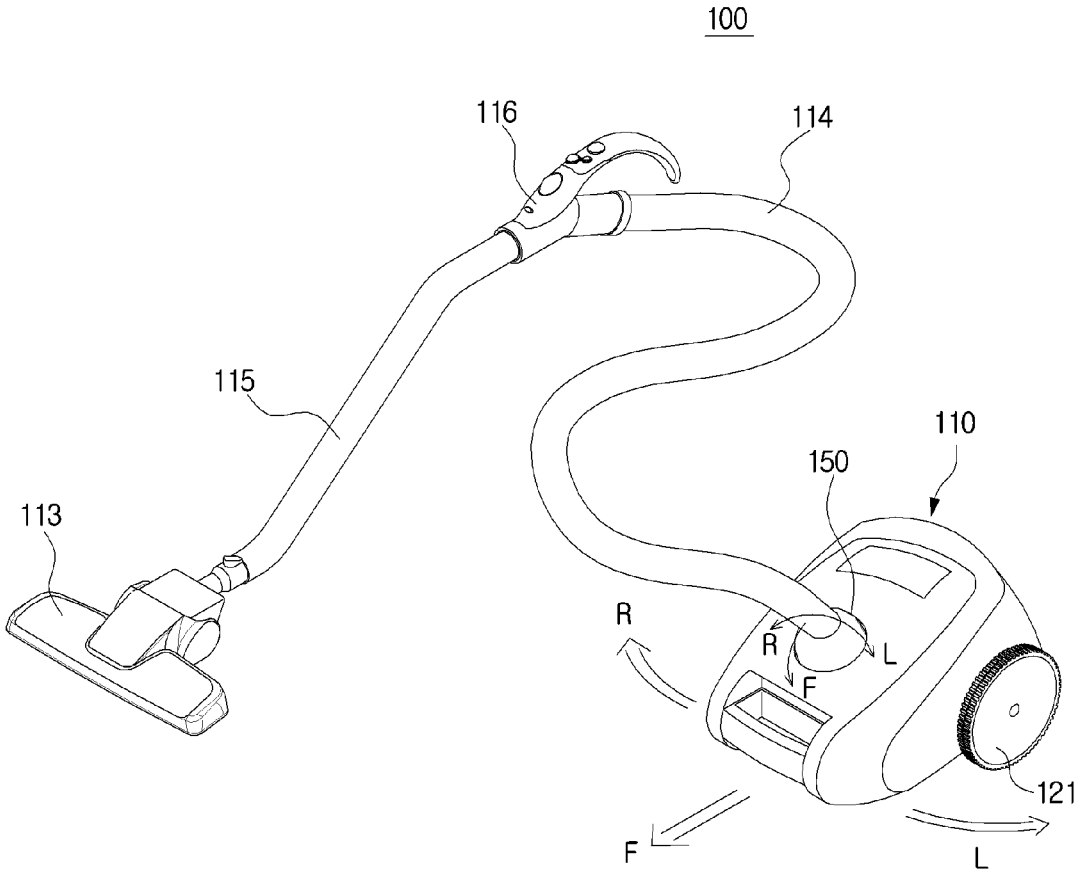
FIG. 1 is a view illustrating an exterior appearance of a vacuum cleaner according to a first embodiment of the present invention.

FIG. 1 is a view illustrating an exterior appearance of a vacuum cleaner according to a first embodiment of the present invention.

With reference to FIG. 1, a vacuum cleaner 100 includes a fan motor (not shown) for generating a suction force, a main body 110 having a dust collector (not shown) for separating dust from air being sucked therein, a suction nozzle 113 for sucking in air from a surface being cleaned, a handle tube 116 for a user operation, an extension tube 115 for connecting the suction nozzle 113 to the handle tube 116, and a suction hose 114 made of a flexible material to connect the handle tube 116 to the main body 110.

The air being sucked in through the suction nozzle 113 passes through sequentially the extension tube 115, the handle tube 116, and the suction hose 114 to be guided to the dust collector of the main body 110. The air from which dust has been separated in the dust collector is discharged back to outside the main body 110.

The dust collector may adopt a dust bag type for separating dust from air by allowing the air to pass through a dust bag, a cyclonic type for separating dust from air by centrifugation, or the like, but is not limited thereto.

Figure 5:
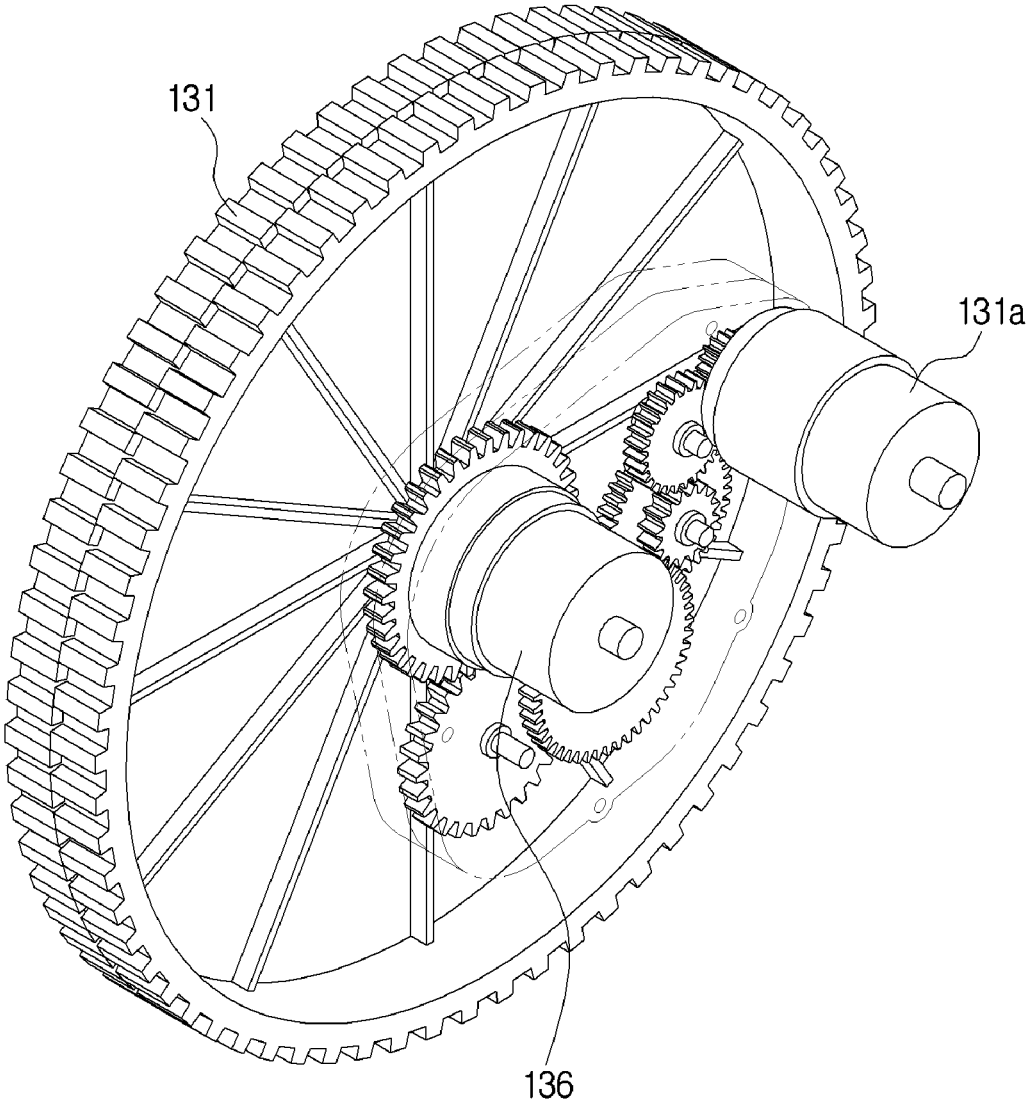
FIG. 5 is an enlarged view illustrating a wheel and a configuration related thereto of the vacuum cleaner shown in FIG. 1.

A left wheel 121 and a right wheel 131 shown in FIG. 5 for movement of the main body 110 are provided at both sides thereof, respectively. As will be described in below, the left wheel 121 and the right wheel 131 may respectively receive driving forces from driving motors 121*a* and 131*a* shown in FIG. 7 in an active driving mode of the vacuum cleaner, whereas they may be disconnected from the driving motors 121*a* and 131*a*, thereby being rotated manually in a manual driving mode of the vacuum cleaner.

Although the driving motors 121*a* and 131*a* may be a bidirectional or unidirectional rotary motor, they may be assumed as a unidirectional rotary motor in these embodiments of the present invention. Therefore, it is assumed that the left wheel 121 and the right wheel 131 are rotated in one direction.

Also, although outputs of the driving motors 121*a* and 131*a* may be varied to change a rotational speed of the left wheel 121 or the right wheel 131, it is assumed that a rotational speed of each of the left wheel 121 and the right wheel 131 is constant in these embodiments of the present invention. In other words, it is assumed that each of the left wheel 121 and the right wheel 131 is stopped or rotated at a constant rotational speed.

Each of the left wheel 121 and the right wheel 131 is fixed so as not to be rotated in left and right directions. However, since one of the left wheel 121 and the right wheel 131 is driven when the remaining wheel has been stopped, the main body 100 may rotate in a left direction L or a right direction R. Of course, when the left wheel 121 and the right wheel 131 are rotated together, the main body 100 may move in a forward direction F.

In the active driving mode of the vacuum cleaner, the main body 110 may detect a pulling motion of the suction hose 114 by a user to move in the forward direction, or to rotate in the left or right direction. In other words, the main body 100 may detect movement of the suction hose 114 to perform active driving. For this purpose, an actuator 150 for detecting the movement of the suction hose 114 is provided at an upper portion of the main body 110.

Conventionally, a general structure adopted in an active drivable vacuum cleaner is a structure using ultrasonic distance sensors. That is, the general structure employs ultrasonic sensors, each of which transmits and receives ultrasonic waves, being provided at a handle tube and a main body of the vacuum cleaner and measuring a distance between the handle tube and the main body to activate a driving motor of wheels when the measured distance is equal to or greater than a predetermined value or level, thereby advancing the main body.

Such a general structure may cause not only an excessive increase of manufacturing costs owing to using the ultrasonic distance sensors but also difficulty to enable the main body to immediately follow the handle tube because of controlling the main body to advance only on the basis of a distance regardless of a position of the handle tube without considering forward, backward, left, and right direction movement of the handle tube.

Consequently, although the main body having the general structure performs the active driving, it may be an imperfect active driving and thus the user may manually rotate the main body in the left and right directions.

To address the aforementioned problems, in accordance with the present invention, the actuator 150 described above may detect movement of the suction hose 114 not only in the forward and backward directions but also in the left and right directions, and the main body may advance or rotate in the left or right direction by controlling the wheels according to movement of the suction hose in the forward, backward, left, and right directions. Therefore, active driving may be implemented by perfectly coinciding with movement of the user.

Hereinafter, a configuration and an operation of the actuator 150 will be described in detail.

Figure 2:
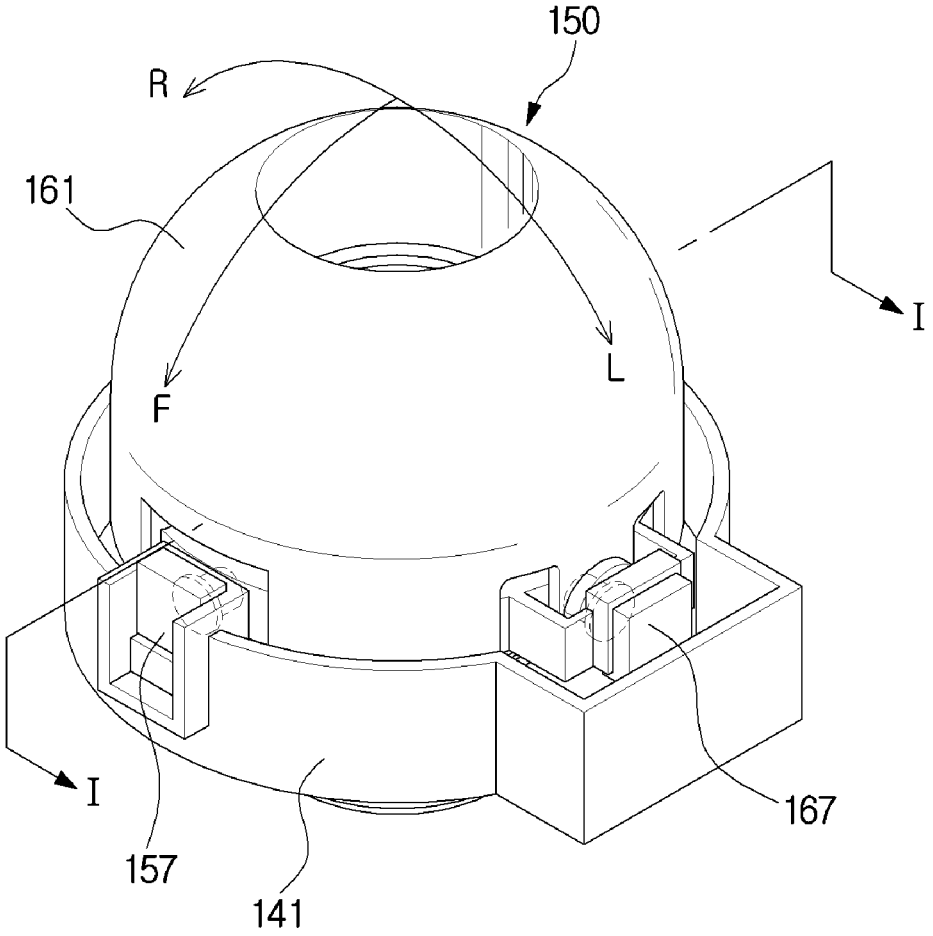
FIG. 2 is an enlarged view illustrating an actuator and a configuration related thereto of the vacuum cleaner shown in FIG. 1.
Figure 3:
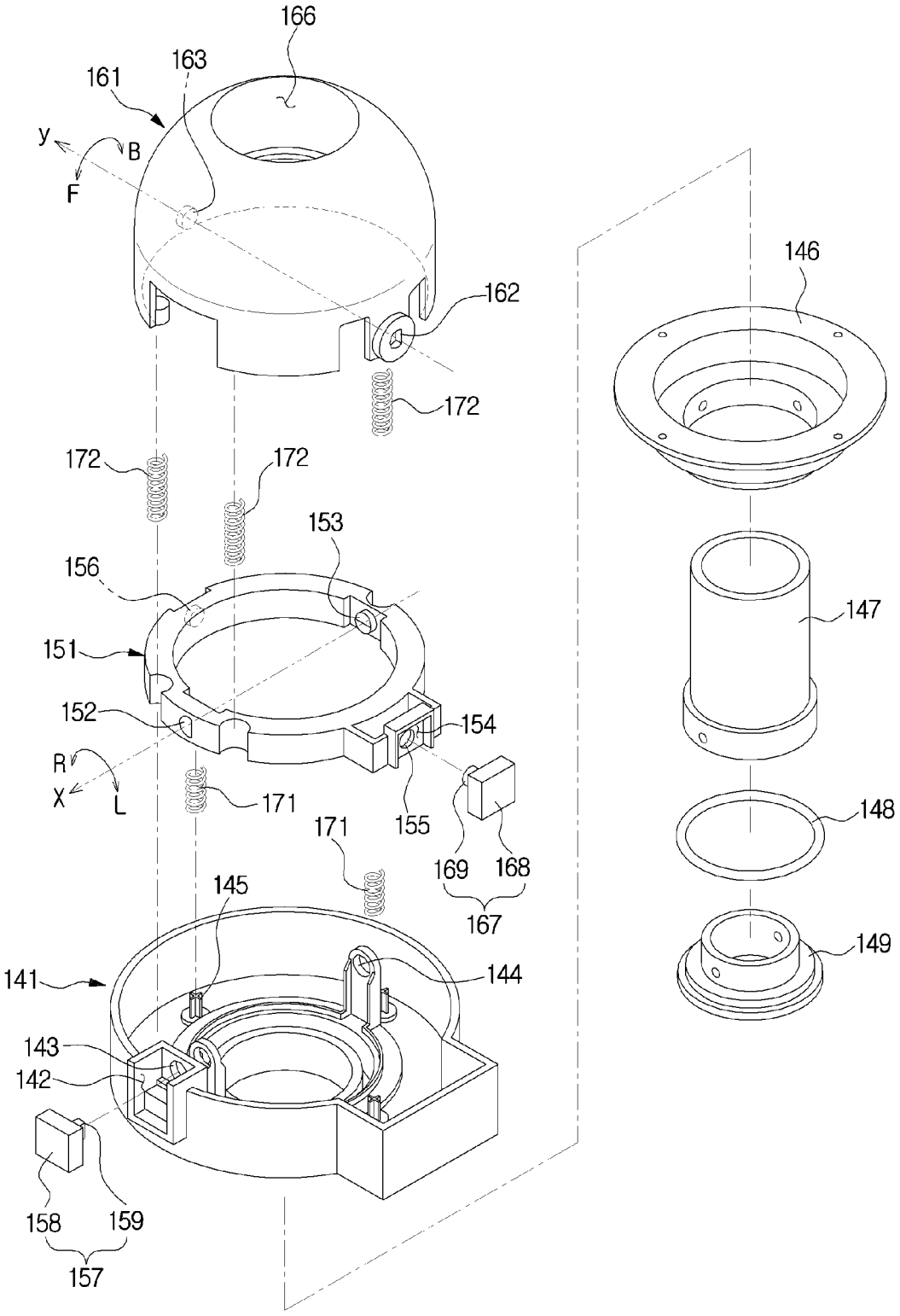
FIG. 3 is an exploded view illustrating the actuator and the configuration related thereto of the vacuum cleaner shown in FIG. 1.
Figure 4:
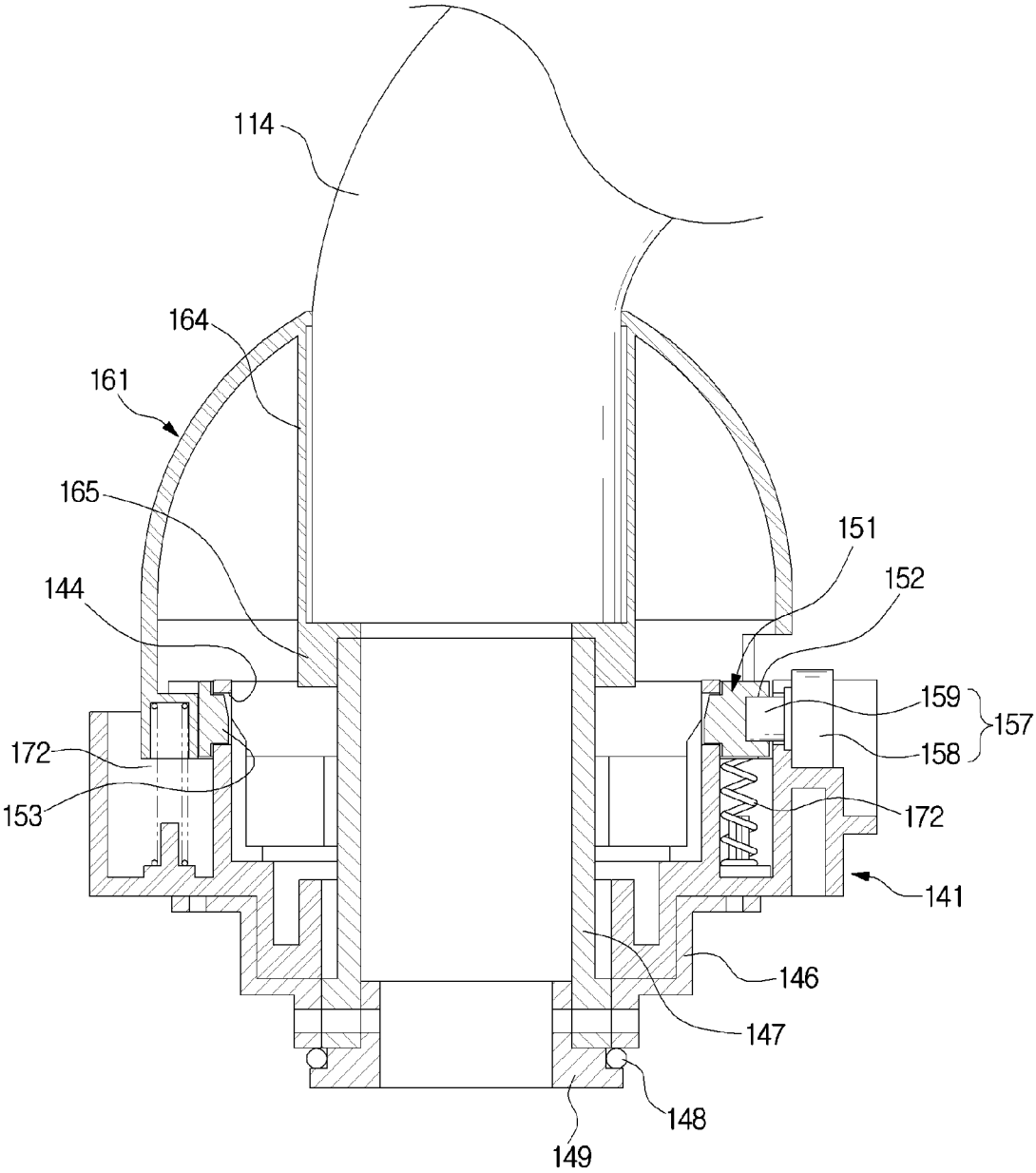
FIG. 4 is a cross-sectional view taken along line I-I of FIG. 2.

FIG. 2 is an enlarged view illustrating the actuator and a configuration related thereto of the vacuum cleaner shown in FIG. 1, FIG. 3 is an exploded view illustrating the actuator and the configuration related thereto of the vacuum cleaner shown in FIG. 1, and FIG. 4 is a cross-sectional view taken along line I-I of FIG. 2.

With reference to FIGS. 1 to 4, the actuator 150 includes a first rotating body 551 being rotatable in left and right directions centering on an X-axis, and a second rotating body 561 being rotatable in forward and backward directions centering on a Y-axis and connected to the suction hose 114.

Here, the forward, backward, left, and right directions are described by centering on the main body 110 of the vacuum cleaner shown in FIG. 1, and likewise, a direction will be described in below by centering on the main body 110. The X-axis is formed on a virtual central division plane (not shown) approximately bisecting the main body 110 to the left and right and the Y-axis is vertically formed on the virtual central division plane.

The first rotating body 551 may have an approximate doughnut shape and the second rotating body 561 may have an approximately hemispherical shape.

The first rotating body 551 may be coupled to a supporting body 141. The supporting body 141 is a component that is fixed to the main body 110 so as to support the actuator 150. If a separate structure for supporting the actuator 150 is formed on the main body 110 in one unit, the supporting body 141 may be omitted.

In particular, the first rotating body 551 is coupled to the supporting body 141 to relatively rotate in the left and right directions centering on the X-axis with respect to the supporting body 141. The second rotating body 561 is coupled to the first rotating body 551 to relatively rotate with respect to the first rotating body 551 in the forward and backward directions centering on the Y-axis.

For this purpose, supporting shaft coupling holes 144 are provided at the supporting body 141, and a supporting shaft 153, which is rotatably coupled to the supporting shaft coupling holes 144, is provided at the first rotating body 551. The supporting shaft 153 is rotatably coupled to the supporting shaft coupling holes 144, such that the first rotating body 551 may relatively rotate with respect to the first supporting body 141 in the left and right directions centering on the X-axis.

A supporting shaft coupling hole 156 to which a supporting shaft 163 of the second rotating body 561 is rotatably coupled is provided at the first rotating body 551. The supporting shaft 163 is rotatably coupled to the supporting shaft coupling hole 156, such that the second rotating body 561 may relatively rotate with respect to the first rotating body 551 in the forward and backward directions centering on the Y-axis.

The suction hose 114 is inserted into and coupled to a hollow 166 of the second rotating body 561. A suction hose coupling tube 164 shown in FIG. 4 for tightly supporting the suction hose 114 is provided inside the second rotating body 561. When the suction hose 114 moves, the actuator 150 may move together along with movement of the suction hose 114.

With such a configuration, the actuator 150 may rotate along with the movement of the suction hose 114 in the left and right directions centering on the X-axis or in the forward and backward directions centering on the Y-axis.

The reason is that the forward and backward direction movement of the suction hose 114 centering on the Y-axis is delivered to the second rotating body 561 so that the second rotating body 561 rotates in the forward and backward directions centering on the Y-axis, whereas the forward and backward direction movement of the suction hose 114 centering on the X-axis is delivered to the first rotating body 551 through the second rotating body 561 and the supporting shaft 163 so that the first rotating body 551 rotates in the left and right directions centering on the X-axis.

Multiple displacement sensors 157 and 167 are provided at the vacuum cleaner 100 to detect a rotational displacement of the actuator 150. The multiple displacement sensors 157 and 167 may be potentiometers having sensor bodies 158 and 168 and adjustment knobs 159, 169 which are rotatably provided at the sensor bodies 158 and 168 to change resistance. The first displacement sensor 157 of the multiple displacement sensors 157 and 167 may be coupled to the supporting body 141 to detect a rotational displacement of the first rotating body 551 with respect to the supporting body 141 in the left and right directions centering on the X-axis.

For this purpose, the first sensor body 158 of the first displacement sensor 157 may be fixed to the supporting body 141, and the first adjustment knob 159 may be inserted into the first rotating body 551 to be rotated together therewith.

Also, a first sensor body coupling recession 142 at which the first sensor body 158 is inserted into and fixed to, and a first adjustment knob through hole 143 through which the first adjustment knob 159 passes may be provided at the supporting body 141. A first adjustment knob inserting recession 152 into which the first adjustment knob 159 is inserted may be provided at the first rotating body 551.

The second displacement sensor 167 of the multiple displacement sensors 157 and 167 may be coupled to the first rotating body 551 to detect a rotational displacement of the second rotating body 561 with respect to the first rotating body 551 in the forward and backward directions centering on the Y-axis.

For this purpose, the first sensor body 168 of the second displacement sensor 167 may be fixed to the first rotating body 551, and the second adjustment knob 169 may be inserted into the second rotating body 561 to be rotated together therewith.

Also, a second sensor body coupling recession 154 at which the second sensor body 168 is inserted into and fixed to, and a second adjustment knob through hole 155 through which the second adjustment knob 169 passes may be provided at the first rotating body 551. A second adjustment knob inserting recession 162 into which the second adjustment knob 169 is inserted may be provided at the second rotating body 561.

Meanwhile, as shown in FIG. 1, the actuator 150 is provided at the upper portion of the main body 110. As such, the actuator 150 is provided at the upper portion of the main body 110 so that the suction hose 114 is pulled in the forward direction when the user is advancing the handle tube 116, and thus the actuator 150 rotates in the forward direction when the suction hose 114 is being pulled in the forward direction. In other words, a rotational displacement of the actuator 150 occurs in the forward direction.

When the user is moving the handle tube 116 in the left direction, the suction hose 114 is pulled in the left direction, and thus the actuator 150 rotates in the left direction when the suction hose 114 is being pulled in the left direction. In other words, a rotational displacement of the actuator 150 occurs in the left direction.

Also, when the user is moving the handle tube 116 in the right direction, the suction hose 114 is pulled in the right direction, and thus the actuator 150 rotates in the right direction when the suction hose 114 is being pulled in the right direction. In other words, a rotational displacement of the actuator 150 occurs in the right direction.

As such, when the rotational displacement of the actuator 150 in the forward, left and right directions occurs, the occurred rotational displacement is detected by the aforementioned displacement sensors 157 and 167. The rotational displacement detected through the displacement sensors 157 and 167 is delivered to a control unit 180 shown in FIG. 7, and then the control unit 180 controls activation of the left wheel driving motor 121*a* and the right wheel driving motor 131*a* on the basis of the detected rotational displacement.

For example, when a rotational displacement of the actuator 150 occurs in the forward direction, the control unit 180 may activate all of the left wheel driving motor 121*a* and the right wheel driving motor 131*a* to advance the main body 110. When a rotational displacement of the actuator 150 occurs in the left direction, the control unit 180 may activate only the right wheel driving motor 131*a* rather than the left wheel driving motor 121*a* to rotate the main body 110 in the left direction. On the contrary, when a rotational displacement of the actuator 150 occurs in the right direction, the control unit 180 may activate only the left wheel driving motor 121*a* rather than the right wheel driving motor 131*a* to rotate the main body 110 in the right direction.

With such a configuration, the main body 110 may appropriately perform the active driving according to the movement of the handle tube 116 and the movement of the suction hose 114 resulting from the movement of the handle tube 116.

With reference to FIGS. 3 and 4, the vacuum cleaner 100 further includes elastic members 171 and 172 for elastically supporting the actuator 150. The elastic members 171 and 172 may restore a position of the actuator 150 when pressurizing the actuator 150 is released.

One ends of the elastic members 171 and 172 are provided to be supported by the supporting body 141 and the other ends thereof are provided to be supported by the first rotating body 551, and the elastic members 171 and 172 may include the first elastic members 171 for elastically supporting the first rotating body 551, and the second elastic members 172, each of which has one end being provided to be supported by the supporting body 141 and the other end being provided to be supported by the second rotating body 561, for elastically supporting the second rotating body 561.

The first elastic members 171 elastically support the first rotating body 551 to restore to the original position thereof after the first rotating body 551 rotated in the left and right directions centering on the X-axis, whereas the second elastic members 172 elastically support the second rotating body 561 to restore to the original position thereof after the second rotating body 561 rotated in the forward and backward directions centering on the Y-axis.

Spring supporters 145 for supporting the elastic members 171 and 172 may be provided at the supporting body 141. The elastic members 171 and 172 may be a compression coil spring.

As in a second embodiment and a fourth embodiment to be described later, instead of using the multiple elastic members 171 and 172 for elastically supporting the actuator, only one elastic member 271 may be used.

As shown in detail in FIGS. 3 and 4, an inner hose 147, which communicates with the suction hose 114 to guide air being sucked in therethrough to the dust collector (not shown) inside the main body 110, may be provided inside the actuator 150.

The inner hose 147 may be inserted into and fixed to an inner hose coupling tube 165 provided at a lower portion of the second rotating body 561, thereby communicating with the suction hose 114. The inner hose 147 may be made of a flexible material not only to be deformed flexibly according to rotation of the second rotating body 561 but also to enable the second rotating body 561 to freely rotate.

An upper connector 146 and a lower connector 149 for fixing the supporting body 141 to the main body 110 may be provided at a lower portion of the supporting body 141, and a sealing member 148 for maintaining airtightness may be provided between the upper connector 146 and the lower connector 149.

As in a third embodiment and the fourth embodiment to be described later, instead of using the flexible inner hose, vent units 346 and 348 provided to be freely rotated by a universal joint may be provided.

Figure 6:
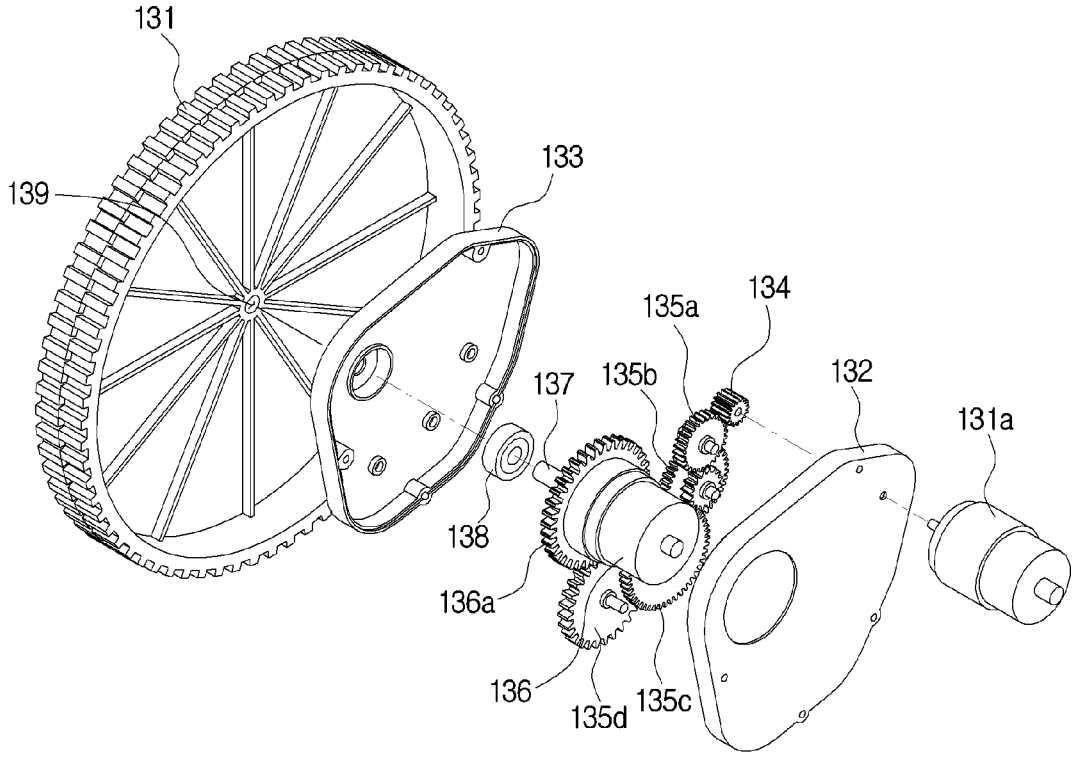
FIG. 6 is an exploded view illustrating the wheel and the configuration related thereto of the vacuum cleaner shown in FIG. 1.

FIG. 5 is an enlarged view illustrating the wheel and a configuration related thereto of the vacuum cleaner shown in FIG. 1, and FIG. 6 is an exploded view illustrating the wheel and the configuration related thereto of the vacuum cleaner shown in FIG. 1.

With reference to FIGS. 1 to 6, a configuration and an operation of a clutch 136 for a mutual conversion between an active driving mode and a manual driving mode of the vacuum cleaner 100 according to the embodiment of the present invention will be described.

As described above, the vacuum cleaner 100 has the wheels 121 and 131 provided at both sides of the main body 110 for the active driving thereof, and the driving motors 121*a* and 131*a* for providing the wheels 121 and 131 with the driving forces. The clutch 136 serves to connect or disconnect the wheels 121 and 131 and the driving motors 121*a* and 131*a*, and a configuration of the clutch 136 is identically applied to both of the wheels 121 and 131 so that explanation with respect to the wheel 131 will be made in below.

As detailed shown in FIG. 6, a drive gear 134 to be rotated in connection with the driving motor 131*a*, reduction gears 135*a*, 135*b*, 135*c*, and 135*d* for reducing a rotational speed of the driving motor 131*a*, and the clutch 136 for connecting or disconnecting the reduction gears 135*a*, 135*b*, 135*c*, and 135*d* and the wheel 131 may be provided between the wheel 131 and the driving motor 131*a*. Although the clutch 136 may be an electronic clutch using a coil and a magnet or a mechanical clutch using a cam and the like, the electronic clutch may be used in the present embodiment of the present invention.

In particular, the drive gear 134 may be connected to the driving motor 131*a*, the reduction gears 135*a*, 135*b*, 135*c*, and 135*d* may be sequentially provided in engagement with the drive gear 134, and a clutch gear 136*a* of the clutch 136 may be connected to the reduction gear 135*d* being provided last.

A rotating shaft 137 of the clutch 136 may be inserted into a rotating shaft inserting recession 139 of the wheel 131 to be rotated together with the wheel 131. If the clutch 136 is in an ON state, a rotational force of the clutch gear 136*a* may be delivered to the rotating shaft 137 of the clutch 136, whereas the rotational force of the clutch gear 136*a* may be not delivered to the rotating shaft 137 of the clutch 136 if the clutch 136 is in an OFF state. In other words, if the clutch 136 is in the OFF state, the wheel 131 may idly rotate regardless of the reduction gears 135*a*, 135*b*, 135*c*, and 135*d* and the driving motor 131*a*.

The clutch 136 is in the ON state in the active driving mode of the vacuum cleaner. Therefore, the wheel 131 performs the active driving according to activation of the driving motor 131*a*.

On the contrary, the clutch 136 is in the OFF state in the manual driving mode of the vacuum cleaner. Therefore, when the user manually pulls to move the main body 110, a connection between the reduction gears 135*a*, 135*b*, 135*c*, and 135*d* and the wheel 131 may be released to enable the wheel 131 to smoothly rotate without interfering with loads of the driving motor 131*a* and the reduction gears 135*a*, 135*b*, 135*c*, and 135*d*.

As such, the clutch 136 may be in an ON or OFF state along with an ON and OFF state of a main power of the vacuum cleaner 100, or a separate ON and OFF function may be provided to the clutch 136.

Figure 7:
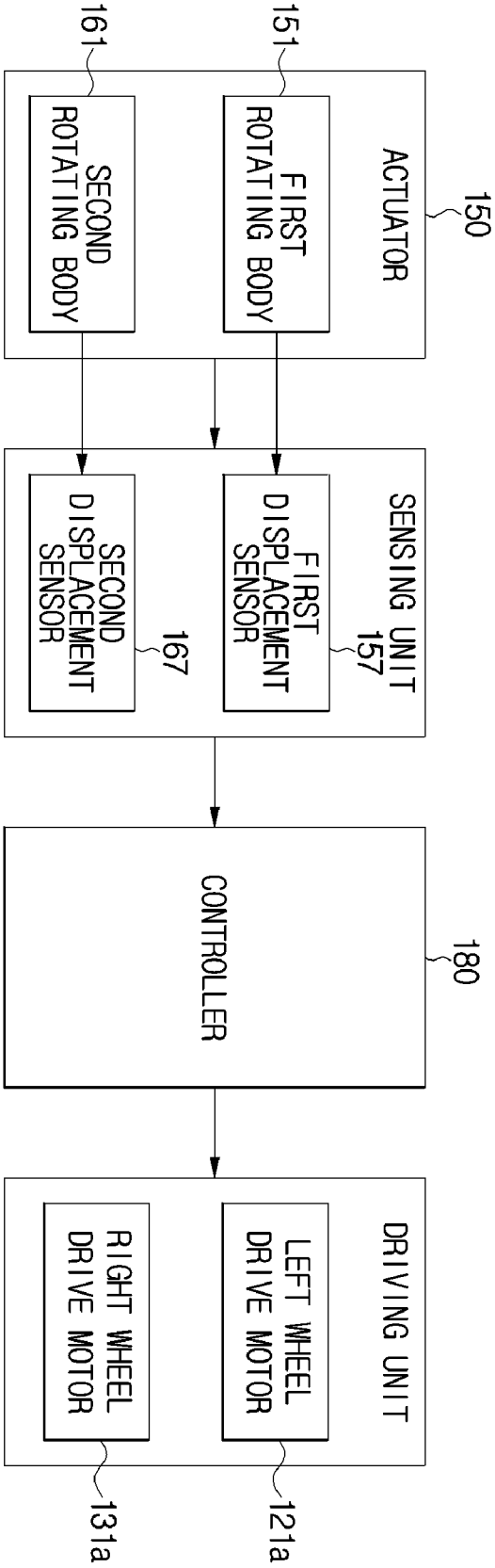
FIG. 7 is a control block diagram of the vacuum cleaner shown in FIG. 1.

FIG. 7 is a control block diagram of the vacuum cleaner shown in FIG. 1.

With reference to FIGS. 1 to 7, an operation of the vacuum cleaner according to the embodiment of the present invention will be described.

When the user is advancing or moving the handle tube 116 in the left and right directions while cleaning, the suction hose 114 connected to the handle tube 116 is pulled in the forward direction or in the left and right directions. According to such movement of the suction hose 114, the actuator 150 provided at the upper portion of the main body 110 rotates in the forward, left, or right direction. Rotational displacement of the actuator 150 in the forward and backward directions and in the left and right directions may be detected by the first displacement sensor 157 and the second displacement sensor 167, respectively.

In particular, the actuator 150 is comprised of the first rotating body 551 coupled to the supporting body 141 to be relatively rotatable in the left and right directions centering on the X-axis, and the second rotating body 561 coupled to the first rotating body 551 to be relatively rotatable in the forward and backward directions centering on the Y-axis.

The first displacement sensor 157 and the second displacement sensor 167 are the potentiometer, and the first sensor body 158 of the first displacement sensor 157 is fixed to the supporting body 141 and the first adjustment knob 159 is inserted into the first rotating body 551 to be rotated together therewith. The second sensor body 168 of the second displacement sensor 167 is fixed to the first rotating body 551, and the second adjustment knob 169 is inserted into the second rotating body 561 to be rotated together therewith.

The detected rotational displacement is delivered to the control unit 180, and thus the control unit 180 may activate the left wheel driving motor 121*a* and the right wheel driving motor 131*a* on the basis of the detected rotational displacement to advance or rotate the main body 110 in the left or right direction.

When the main power of the vacuum cleaner 100 is turned off, or a separate clutch power is turned off, a connection between the driving motors 121*a* and 131*a* and the wheels 121 and 131 is released such that the wheels 121 and 131 may freely rotate without interfering with loads of the driving motors 121*a* and 131*a* and the reduction gears 135*a*, 135*b*, 135*c*, and 135*d*.

Figure 8:
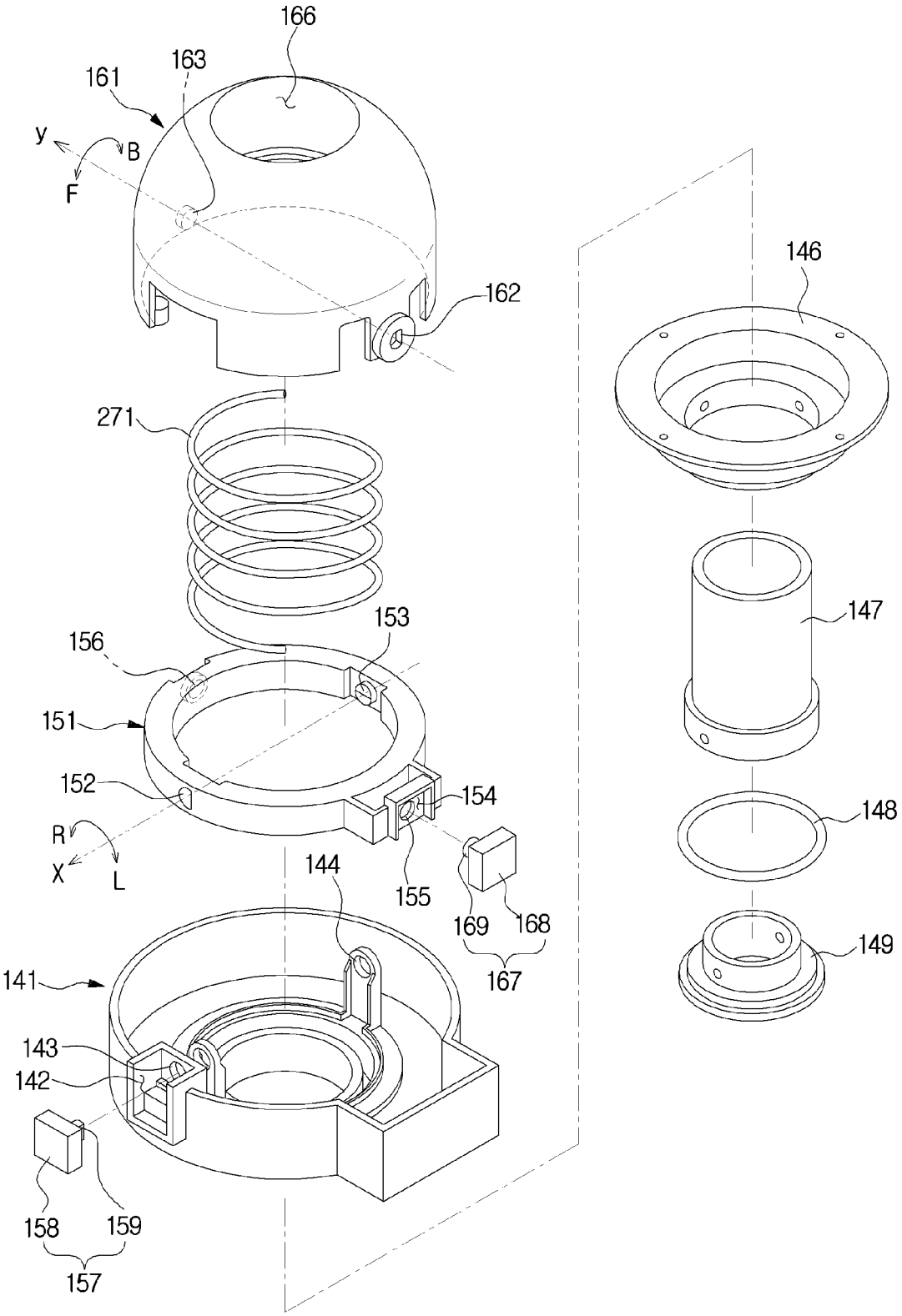
FIG. 8 is an exploded view illustrating an actuator and a configuration related thereto of a vacuum cleaner according to a second embodiment of the present invention.
Figure 9:
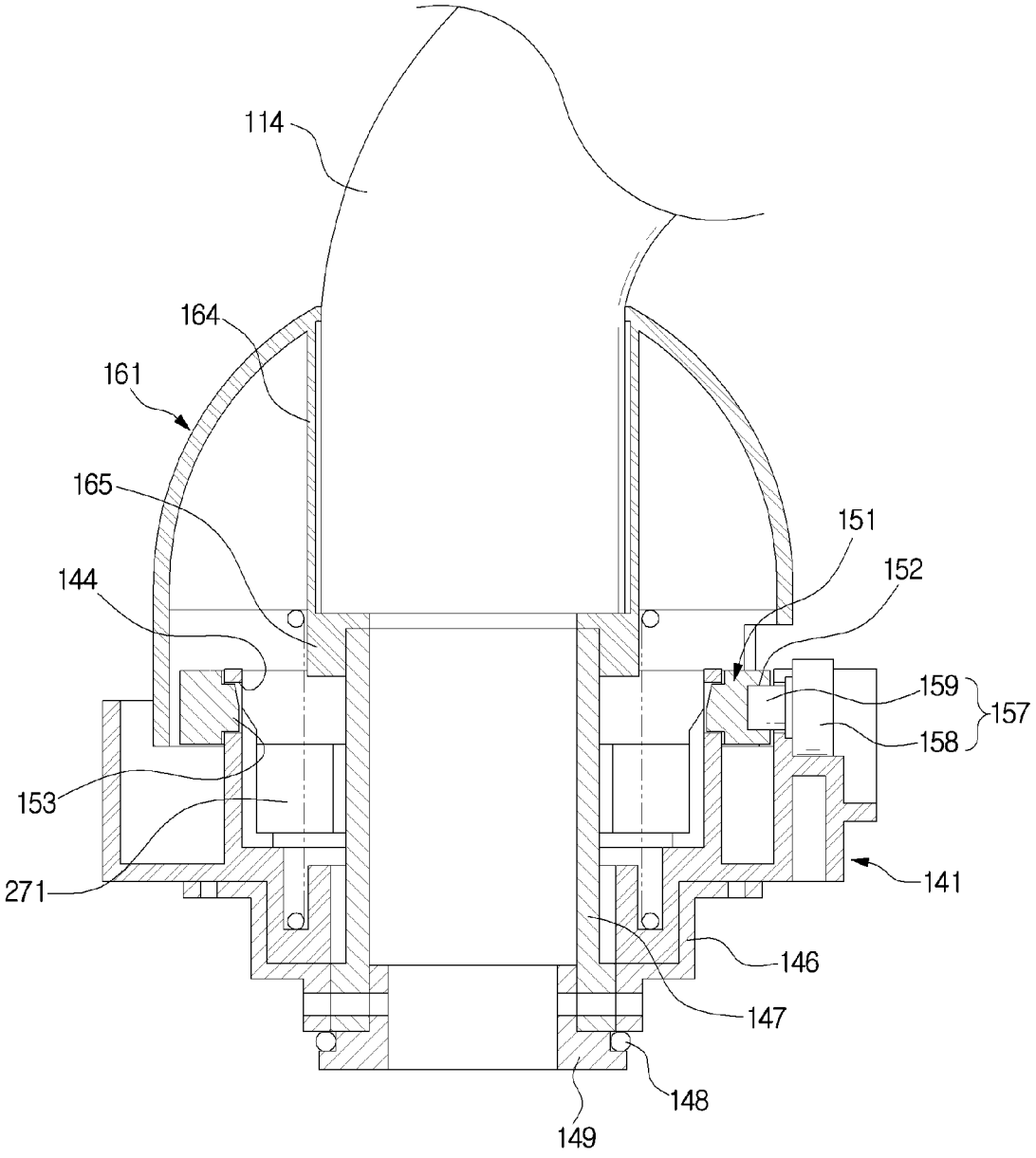
FIG. 9 is a cross-sectional view illustrating the actuator and the configuration related thereto of the vacuum cleaner shown in FIG. 8.

FIG. 8 is an exploded view illustrating an actuator and a configuration related thereto of a vacuum cleaner according to a second embodiment of the present invention, and FIG. 9 is a cross-sectional view illustrating the actuator and the configuration related thereto of the vacuum cleaner shown in FIG. 8.

With reference to FIGS. 8 and 9, the configuration and an operation related thereto of the actuator of the vacuum cleaner according to the second embodiment of the present invention will be described in below. The same reference numerals may be assigned to components identical to those of the first embodiment of the present invention and thus explanation of configurations related to the components may be omitted.

A configuration of the elastic member 271 of the vacuum cleaner according to the second embodiment is distinguished from that of the vacuum cleaner according to the first embodiment.

Although the first rotating body 551 is elastically supported by the first elastic members 171 to be restored to the original position after rotating in the left and right directions centering on the X-axis, and the second rotating body 561 is elastically supported by the second elastic members 172 to be restored to the original position after rotating in the forward and backward directions centering on the Y-axis in the first embodiment of the present invention, one elastic member 271 is provided in the second embodiment of the present invention to elastically support the second rotating body 561, thereby restoring to the original position thereof after the second rotating body 561 is rotated in the forward, backward, left, and right directions with respect to the supporting body 141.

Also, in the first embodiment of the present invention, the elastic members 171 and 172 are arranged to be spaced apart from each other at predetermined intervals in an approximate circumferential direction along with the first rotating body 551, whereas the elastic member 271 in the second embodiment of the present invention is provided by only one on an inner central portion of the first rotating body 551, and one end of the elastic member 271 is supported by the second rotating body 561 and the other end thereof is supported by the supporting body 141.

Other configurations except the elastic member 271 are identical to those of the first embodiment of the present invention, and thus explanation related thereto will be omitted.

Figure 10:
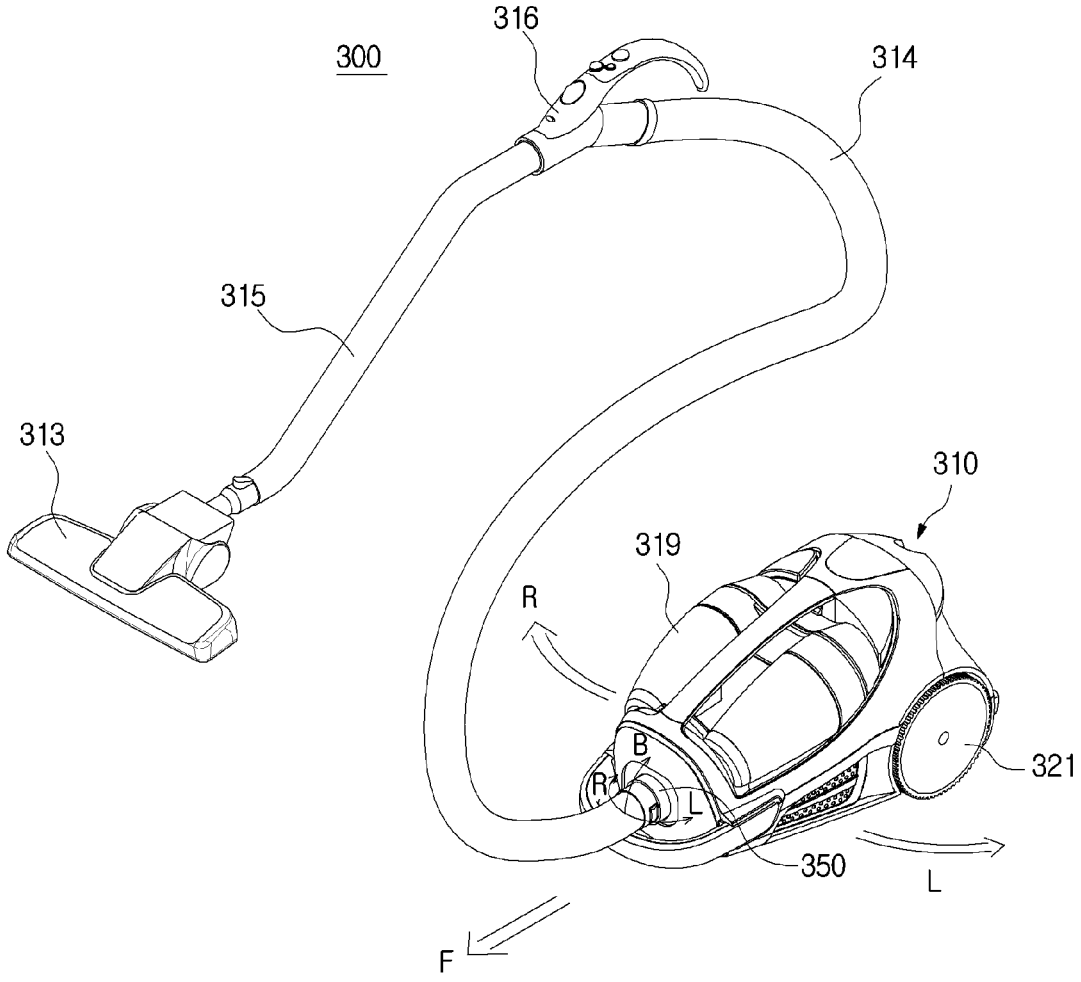
FIG. 10 is a view illustrating an exterior appearance of a vacuum cleaner according to a third embodiment of the present invention.
Figure 11:
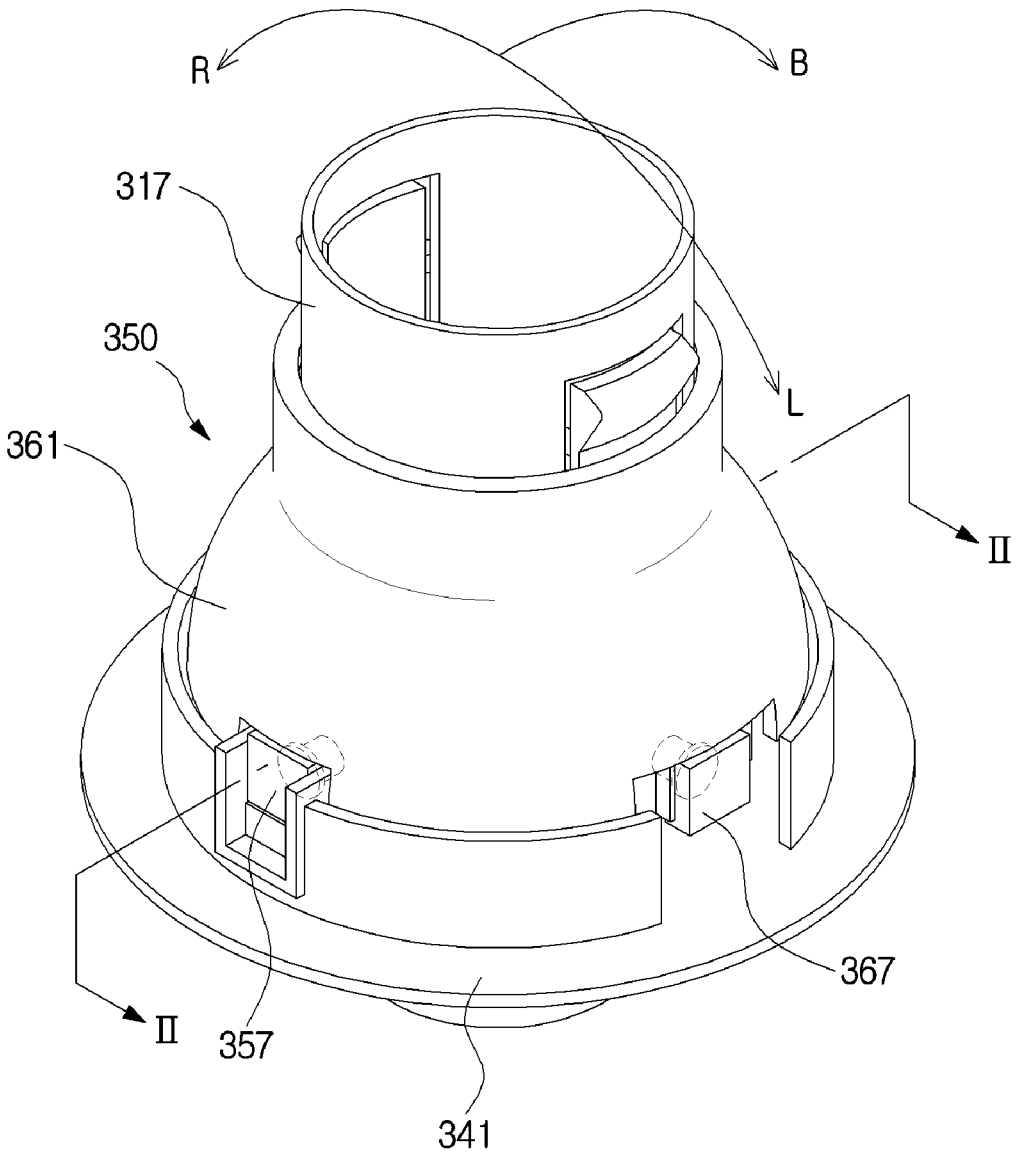
FIG. 11 is an enlarged view illustrating an actuator and a configuration related thereto of the vacuum cleaner shown in FIG. 10.
Figure 12:
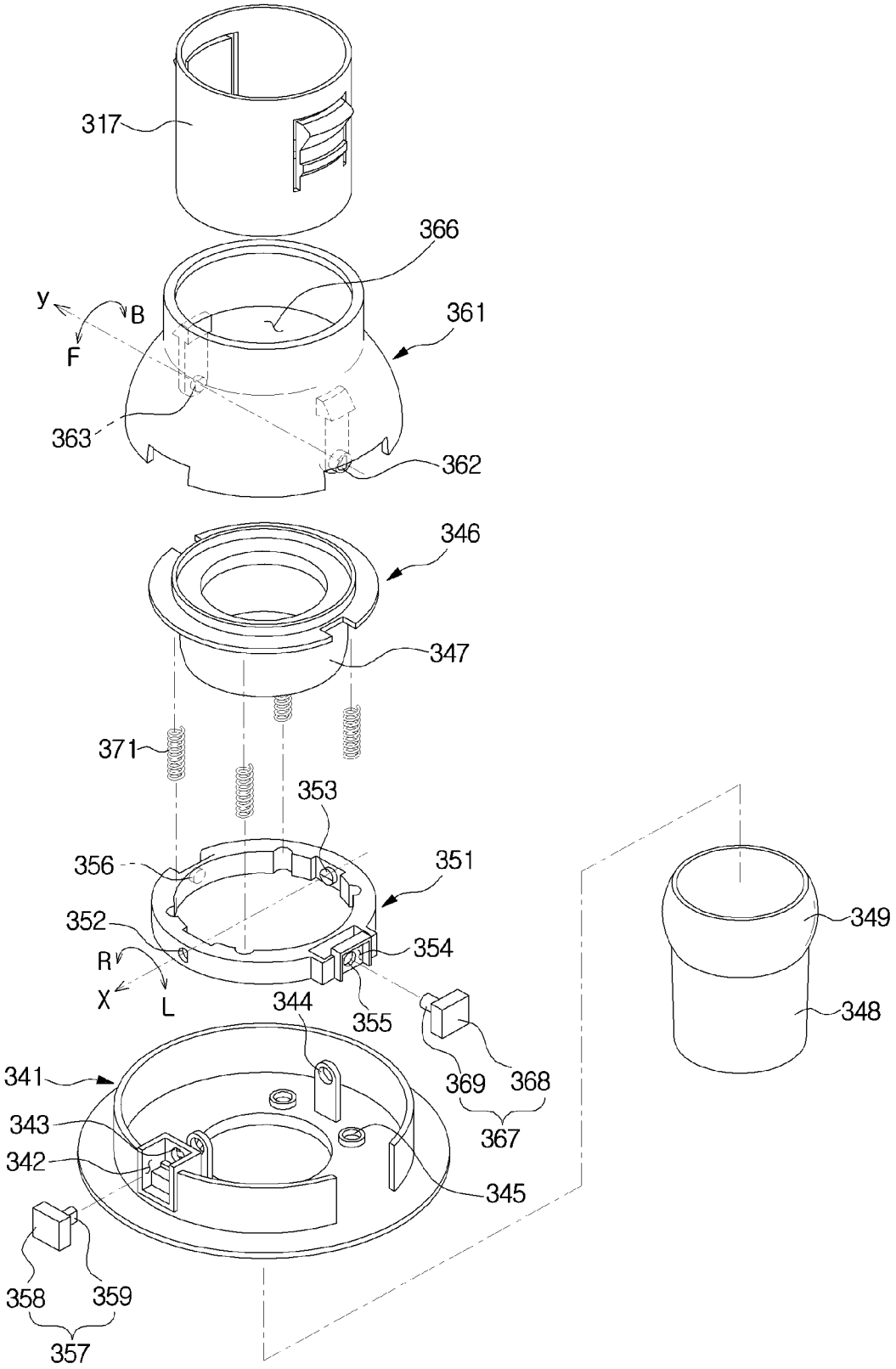
FIG. 12 is an exploded view illustrating the actuator and the configuration related thereto of the vacuum cleaner shown in FIG. 10.
Figure 13:
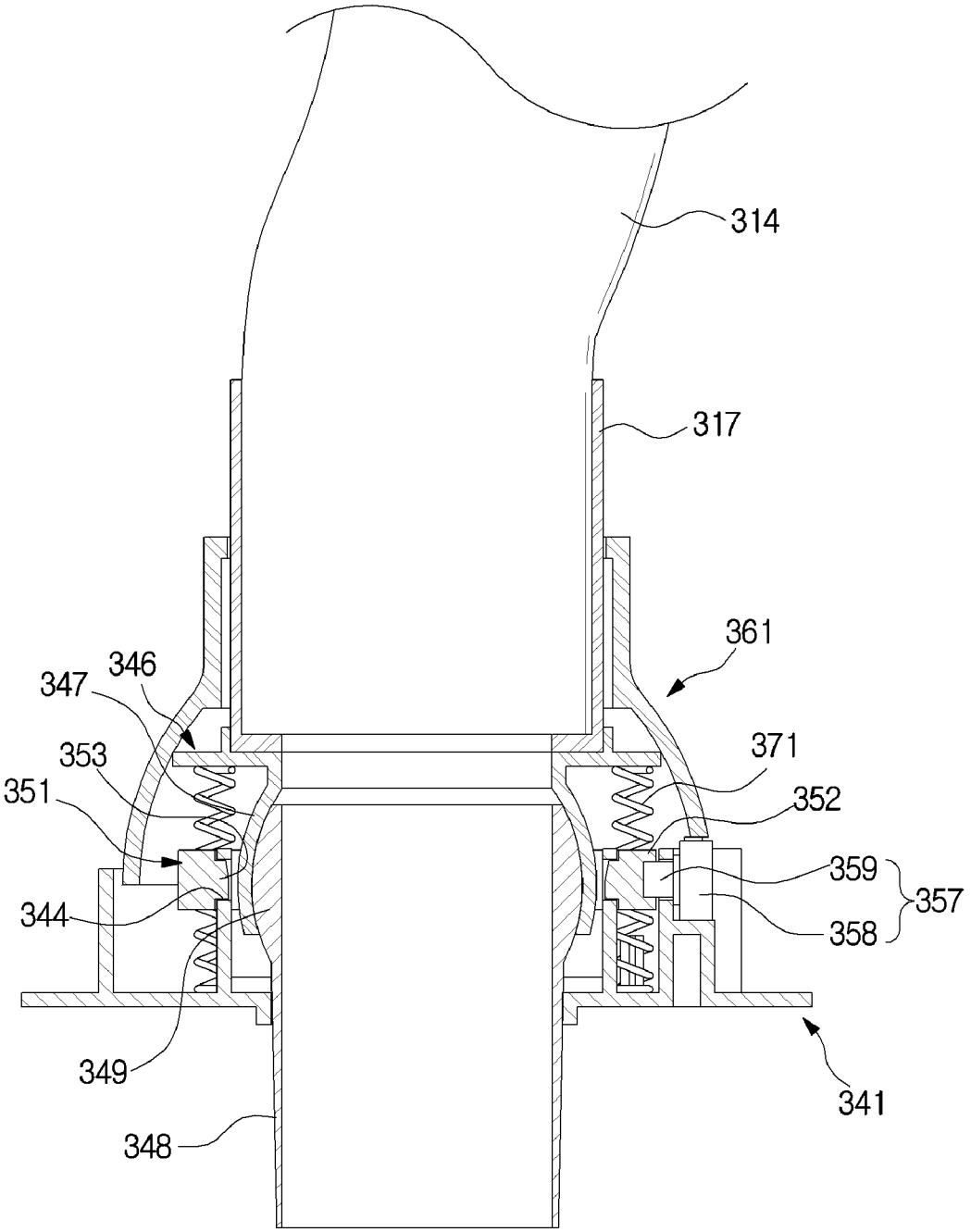
FIG. 13 is a cross-sectional view taken along line II-II of FIG. 11.
Figure 14:
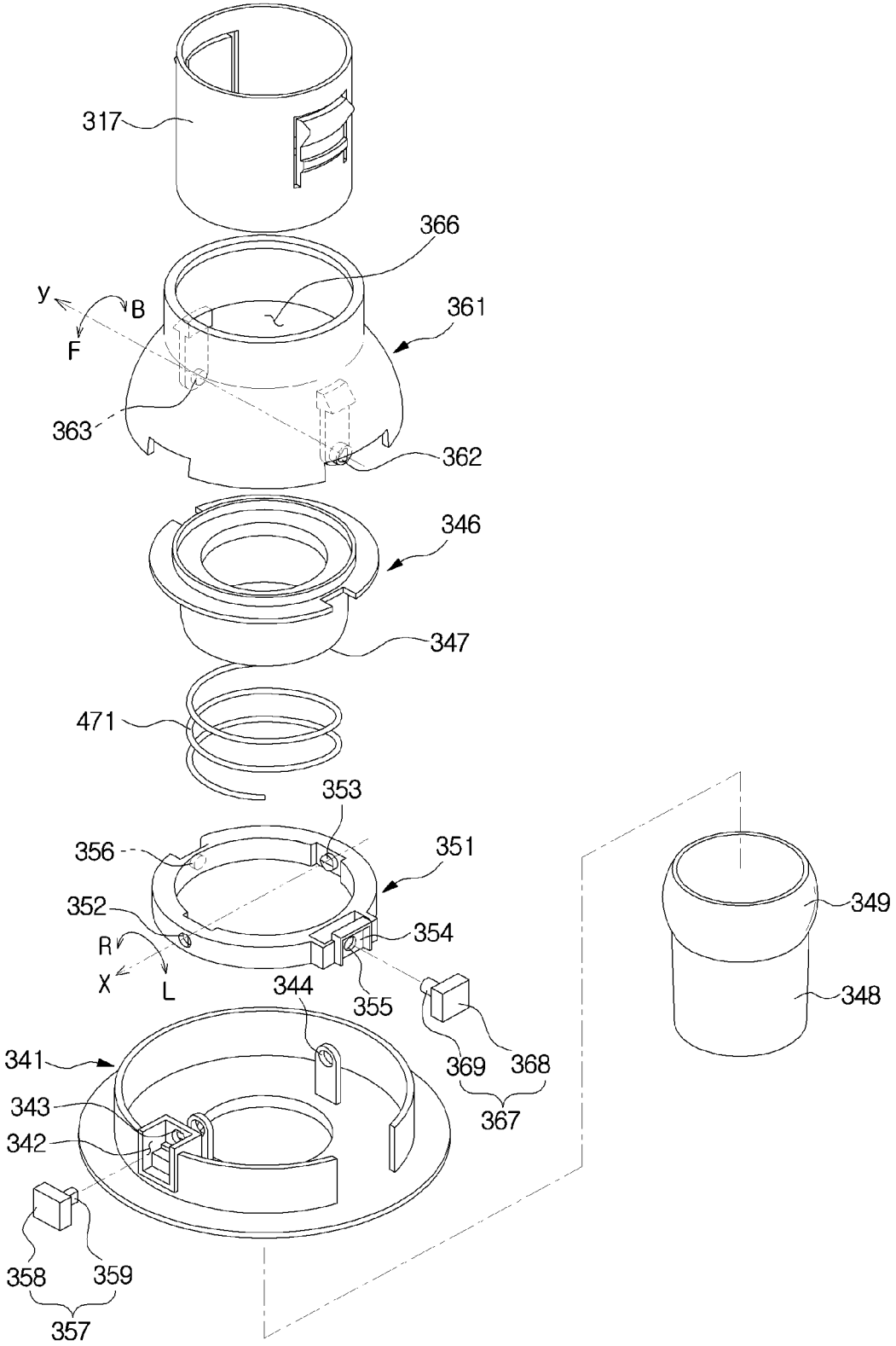
FIG. 14 is an exploded view illustrating an actuator and a configuration related thereto of a vacuum cleaner according to a fourth embodiment of the present invention.
Figure 15:
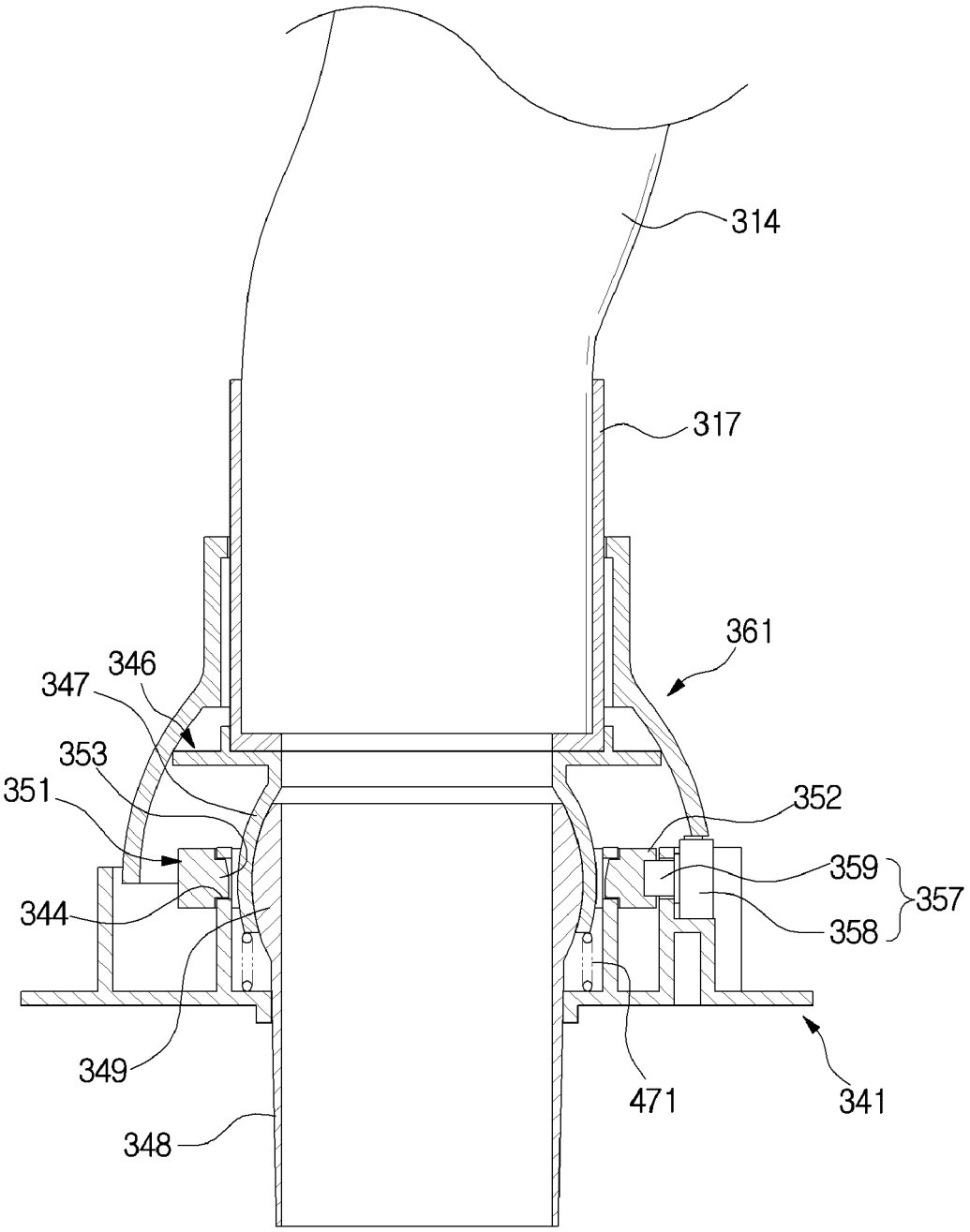
FIG. 15 is a cross-sectional view illustrating the actuator and the configuration related thereto of the vacuum cleaner shown in FIG. 14.

FIG. 10 is a view illustrating an exterior appearance of a vacuum cleaner according to a third embodiment of the present invention. FIG. 11 is an enlarged view illustrating an actuator and a configuration related thereto of the vacuum cleaner shown in FIG. 10. FIG. 12 is an exploded view illustrating the actuator and the configuration related thereto of the vacuum cleaner shown in FIG. 10. FIG. 13 is a cross-sectional view taken along line II-II of FIG. 11. FIG. 14 is an exploded view illustrating an actuator and a configuration related thereto of a vacuum cleaner according to a fourth embodiment of the present invention, and FIG. 15 is a cross-sectional view illustrating the actuator and the configuration related thereto of the vacuum cleaner shown in FIG. 14.

With reference to FIGS. 10 to 14, the configuration of the vacuum cleaner according to the third and fourth embodiments of the present invention will be described in below. The configurations identical to those of the first and second embodiments of the present invention will be not shown and described.

A vacuum cleaner 300 according to the third embodiment of the present invention includes a main body 310 having a fan motor (not shown) for generating a suction force and a dust collector 319 for separating dust from air being sucked in, a suction nozzle 313 for sucking in air from a surface being cleaned, a handle tube 316 for a user operation, an extension tube 315 for connecting the suction nozzle 313 to the handle tube 316, and a suction hose 314 made of a flexible material to connect the handle tube 316 to the main body 310.

A left wheel 321 and a right wheel (not shown) for movement of the main body 310 are provided at both sides thereof. Each of the left wheel 321 and the right wheel may rotate by receiving a driving force from a driving motor (not shown) in the active driving mode of the vacuum cleaner, and manually rotate by being disconnected from the driving motor in the manual driving mode of the vacuum cleaner.

An actuator 350 for detecting movement of the suction hose 314 is provided at a front portion of the main body 310. Unlike the first and second embodiments, the actuator 350 is provided at the front portion of the main body 310.

The actuator 350 includes a first rotating body 351 provided to be rotatable in the left and right directions centering on the X-axis, and a second rotating body 361 provided to be rotatable in the forward and backward directions centering on the Y-axis and connected to the suction hose 314. A connection tube 317 for connecting to the suction hose 314 may be provided at the second rotating body 361.

The first rotating body 351 may have an approximate doughnut shape and the second rotating body 361 may have an approximately hemispherical shape.

The first rotating body 351 may be coupled to a supporting body 341. The supporting body 341 is a component that is fixed to the main body 310 so as to support the actuator 350. If a separate structure for supporting the actuator 350 is formed on the main body 310 in one unit, the supporting body 341 may be omitted.

In particular, the first rotating body 351 is coupled to the supporting body 341 to relatively rotate with respect thereto in the left and right directions centering on the X-axis. The second rotating body 361 is coupled to the first rotating body 351 to relatively rotate with respect thereto in the forward and backward directions centering on the Y-axis.

For this purpose, supporting shaft coupling holes 344 are provided at the supporting body 341, and a supporting shaft 353, which is rotatably coupled to the supporting shaft coupling holes 344, is provided at the first rotating body 351. The supporting shaft 353 is rotatably coupled to the supporting shaft coupling holes 344, such that the first rotating body 351 may relatively rotate with respect to the first supporting body 341 in the left and right directions centering on the X-axis.

A supporting shaft coupling hole 356 to which a supporting shaft 363 of the second rotating body 361 is rotatably coupled is provided at the first rotating body 351. The supporting shaft 363 is rotatably coupled to the supporting shaft coupling hole 356, such that the second rotating body 361 may relatively rotate with respect to the first rotating body 351 in the forward and backward directions centering on the Y-axis.

With such a configuration, the actuator 150 may rotate along with the movement of the suction hose 314 in the left and right directions centering on the X-axis or in the forward and backward directions centering on the Y-axis.

The reason is that the forward and backward direction movement of the suction hose 314 centering on the Y-axis is delivered to the second rotating body 361 so that the second rotating body 361 rotates in the forward and backward directions centering on the Y-axis, whereas the forward and backward direction movement of the suction hose 314 centering on the X-axis is delivered to the first rotating body 351 through the second rotating body 361 and the supporting shaft 363 so that the first rotating body 351 rotates in the left and right directions centering on the X-axis.

Multiple displacement sensors 357 and 367 are provided at the vacuum cleaner 100 to detect a rotational displacement of the actuator 350. The multiple displacement sensors 357 and 367 may be potentiometers having sensor bodies 358 and 368 and adjustment knobs 359, 369 which are rotatably provided at the sensor bodies 358 and 368 to change resistance.

The first displacement sensor 357 of the multiple displacement sensors 357 and 367 may be coupled to the supporting body 341 to detect a rotational displacement of the first rotating body 351 with respect to the supporting body 341 in the left and right directions centering on the X-axis.

For this purpose, the first sensor body 358 of the first displacement sensor 357 may be fixed to the supporting body 341, and the first adjustment knob 359 may be inserted into the first rotating body 351 to be rotated together therewith.

Also, a first sensor body coupling recession 342 at which the first sensor body 358 is inserted into and fixed to, and a first adjustment knob through hole 343 through which the first adjustment knob 359 passes may be provided at the supporting body 341. A first adjustment knob inserting recession 352 into which the first adjustment knob 359 is inserted may be provided at the first rotating body 351.

The second displacement sensor 367 of the multiple displacement sensors 357 and 367 may be coupled to the first rotating body 351 to detect a rotational displacement of the second rotating body 361 with respect to the first rotating body 351 in the forward and backward directions centering on the Y-axis.

For this purpose, the first sensor body 368 of the second displacement sensor 367 may be fixed to the first rotating body 351, and the second adjustment knob 369 may be inserted into the second rotating body 361 to be rotated together therewith.

Also, a second sensor body coupling recession 354 at which the second sensor body 368 is inserted into and fixed to, and a second adjustment knob through hole 355 through which the second adjustment knob 369 passes may be provided at the first rotating body 351. A second adjustment knob inserting recession 362 into which the second adjustment knob 369 is inserted may be provided at the second rotating body 361.

Meanwhile, as shown in FIG. 10, the actuator 350 is provided at the front portion of the main body 310. As such, the actuator 350 is provided at the upper portion of the main body 310, such that the suction hose 314 is pulled in the backward direction when the user is advancing the handle tube 316 and the actuator 350 rotates in the backward direction when the suction hose 314 is being pulled in the backward direction. In other words, a rotational displacement of the actuator 350 occurs in the backward direction. This is different from the first embodiment of the present invention.

When the user is moving the handle tube 316 in the left direction, the suction hose 314 is pulled in the left direction, and thus the actuator 350 rotates in the left direction when the suction hose 314 is being pulled in the left direction. In other words, a rotational displacement of the actuator 350 occurs in the left direction. This is identical to the first embodiment of the present invention.

Also, when the user is moving the handle tube 316 in the right direction, the suction hose 314 is pulled in the right direction, and thus the actuator 350 rotates in the right direction when the suction hose 314 is being pulled in the right direction. In other words, a rotational displacement of the actuator 350 occurs in the right direction. This is identical to the first embodiment of the present invention.

As such, when the rotational displacement of the actuator 350 occurs in the backward, left, and right directions, the occurred rotational displacement is detected by the aforementioned displacement sensors 357 and 367. The rotational displacement detected through the displacement sensors 357 and 367 is delivered to a control unit, and then the control unit controls activation of the left wheel driving motor and the right wheel driving motor on the basis of the detected rotational displacement.

For example, when a rotational displacement of the actuator 350 occurs in the backward direction, the control unit may activate all of the left wheel driving motor and the right wheel driving motor to advance the main body 310. When a rotational displacement of the actuator 350 occurs in the left direction, the control unit 380 may activate only the right wheel driving motor rather than the left wheel driving motor to rotate the main body 310 to the left direction. On the contrary, when a rotational displacement of the actuator 350 occurs in the right direction, the control unit may activate only the left wheel driving motor rather than the right wheel driving motor to rotate the main body 310 to the right direction.

As shown in detail in FIGS. 11 and 12, the vent units 346 and 348, which communicate with the suction hose 314 to guide air being sucked in therethrough to the dust collector 319 inside the main body 310, may be provided inside the actuator 350.

The vent units 346 and 348 may be comprised of the first vent unit 346 fixed and coupled to a lower portion of the second rotating body 361 to communicate with the suction hose 314, and the second vent unit 348 freely-rotatably coupled to the first vent unit 346 by a universal joint to communicate with the first vent unit 346.

The universal joint may include a bowl unit 349 having an outer circumferential surface of a spherical shape and provided at the second vent unit 348, and a bowl housing 347 provided at the first vent unit 346 to surround and communicate with the bowl unit 349. The bowl unit 349 and the bowl housing 347 may be respectively provided at each of the first vent unit 346 and the second vent unit 348.

The vacuum cleaner 300 further includes elastic members 371 for elastically supporting the actuator 350. The elastic members 371 may restore a position of the actuator 350 when pressurizing the actuator 350 is released.

One end of each of the elastic members 371 may be provided to be supported by the supporting body 341 and the other end thereof may be provided to be supported by the first vent unit 346, thereby elastically supporting the first vent unit 346. The first vent unit 346 is fixed and coupled to the second rotating body 361 such that the second rotating body 361 may be elastically supported by the elastic members 371.

Although the elastic members 371 are arranged to be spaced apart from each other at predetermined intervals along with an approximate circumferential direction, an elastic member 471 may be provided by only one on a central portion as in the fourth embodiment of the present invention shown in FIGS. 14 and 15.

As such, other configurations of the fourth embodiment except the elastic member 471 thereof are identical to those of the third embodiment of the present invention, and thus explanation related thereto will be omitted.

Figure 16:
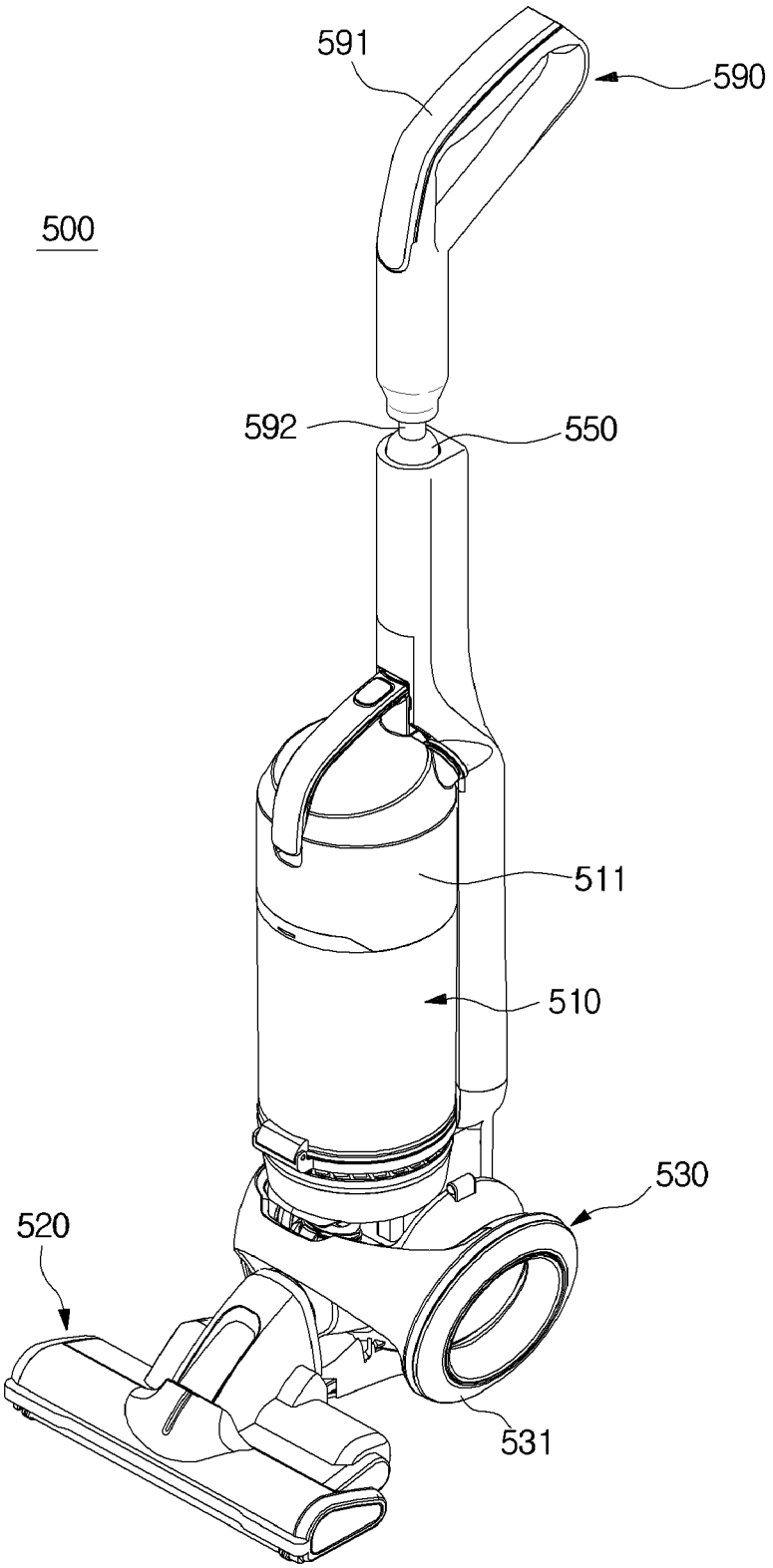
FIG. 16 is a view illustrating an exterior appearance of the vacuum cleaner according to the fourth embodiment of the present invention.
Figure 17:
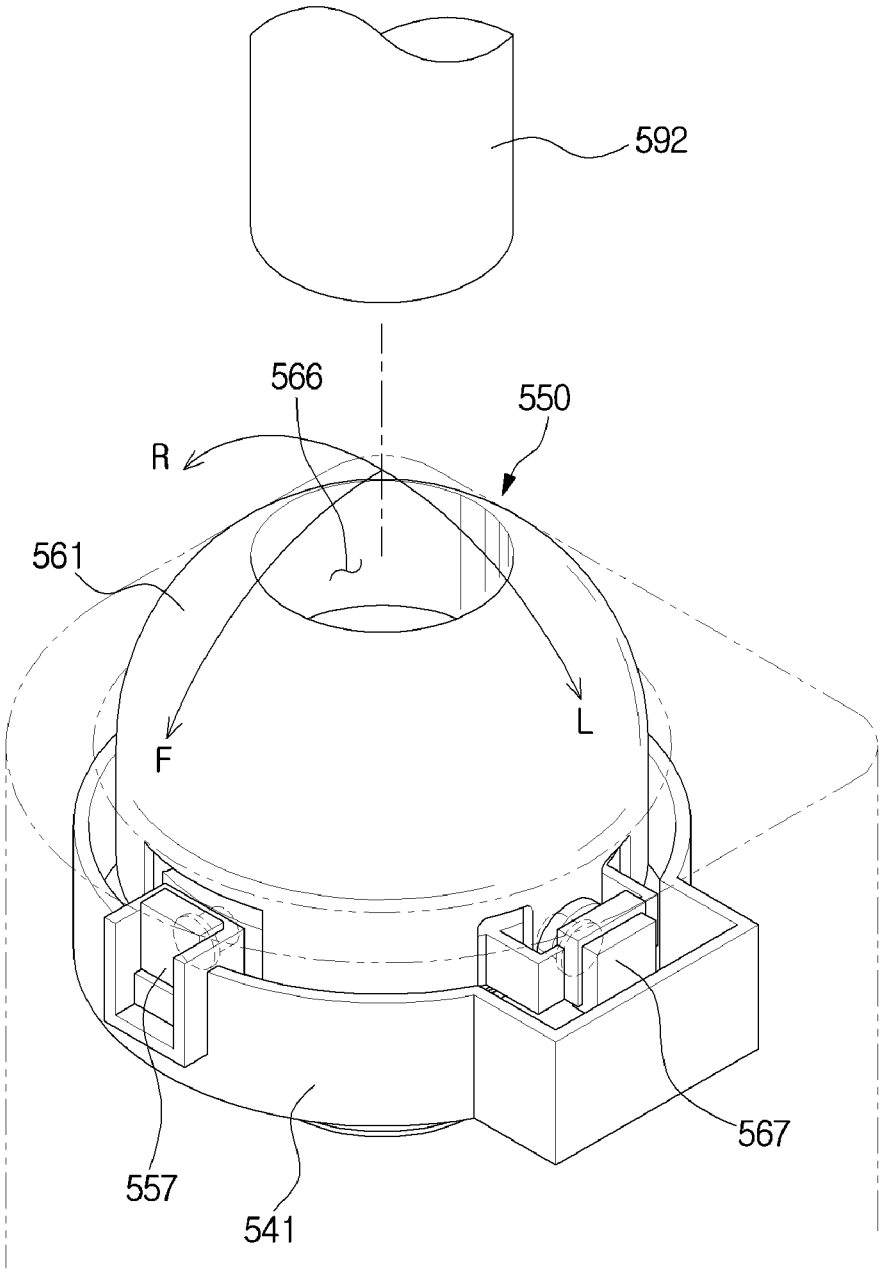
FIG. 17 is an enlarged view illustrating the actuator of the vacuum cleaner shown in FIG. 16.
Figure 18:
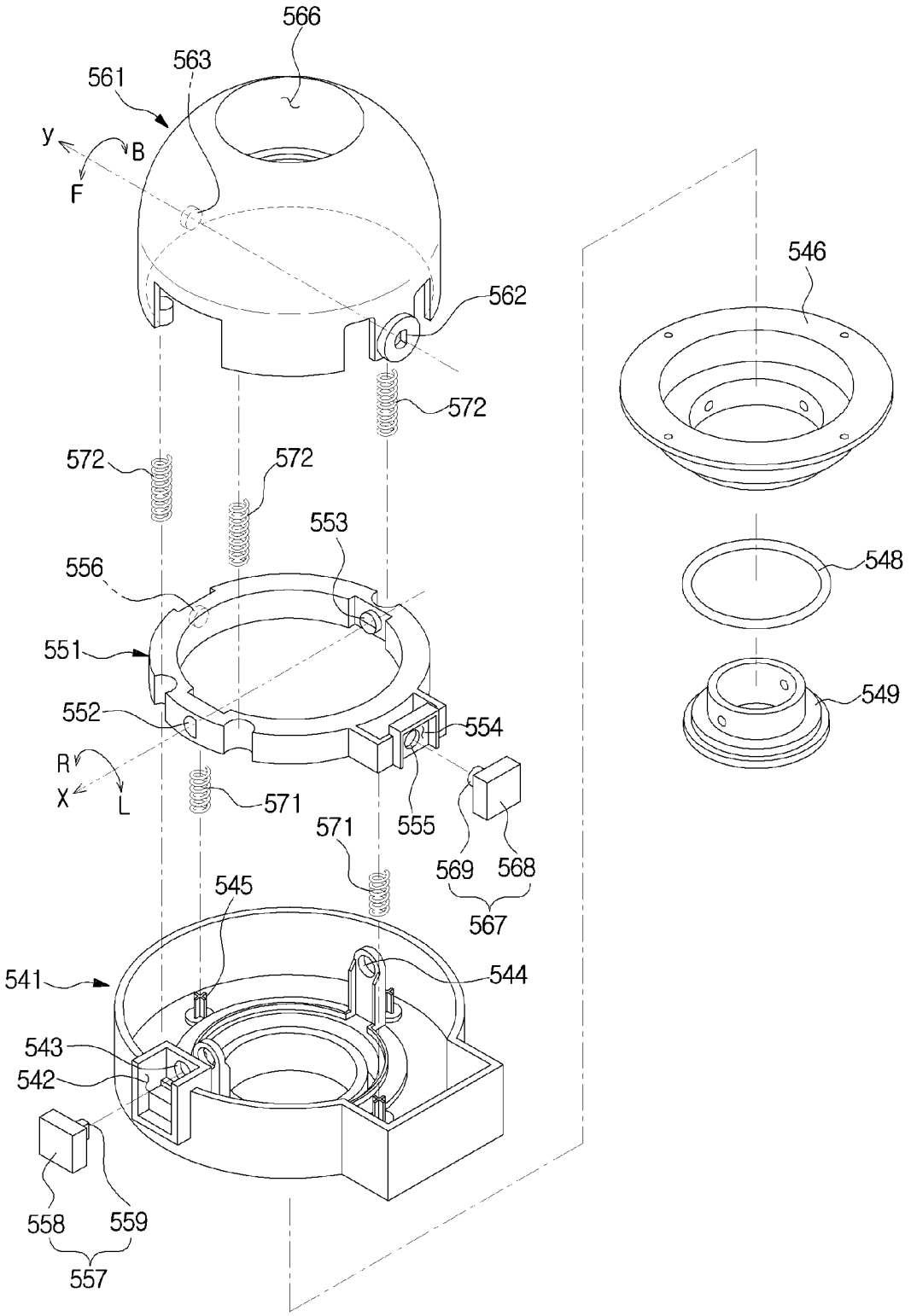
FIG. 18 is an exploded view illustrating the actuator of the vacuum cleaner shown in FIG. 16.
Figure 19:
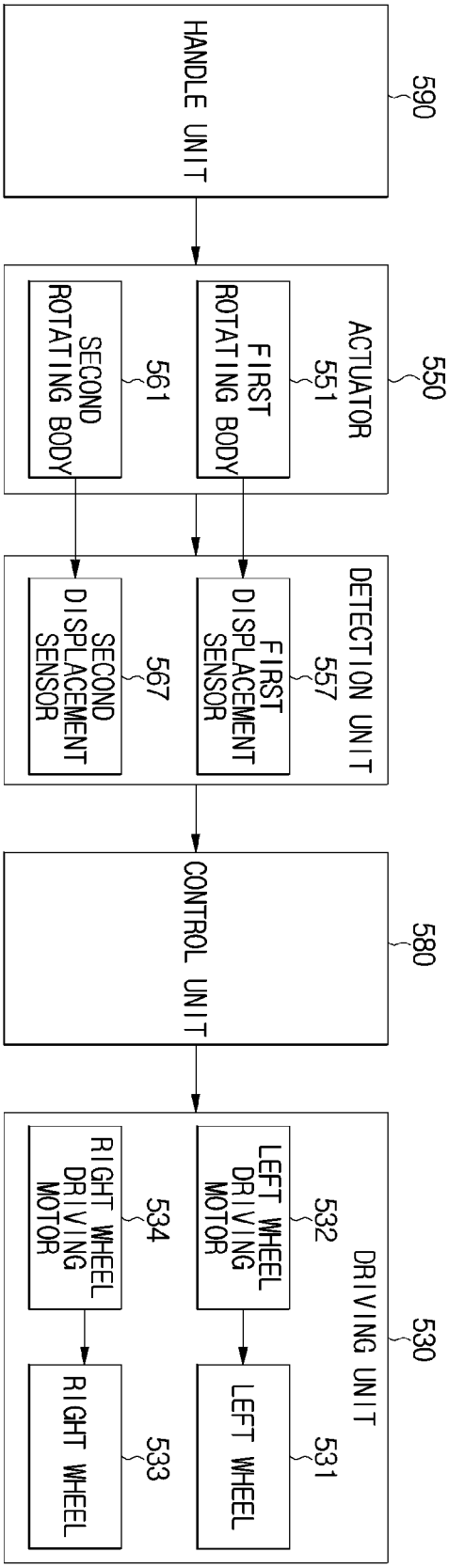
FIG. 19 is a control block diagram of the vacuum cleaner shown in FIG. 16.

FIG. 16 is a view illustrating an exterior appearance of the vacuum cleaner according to the fourth embodiment of the present invention. FIG. 17 is an enlarged view illustrating an actuator of the vacuum cleaner shown in FIG. 16. FIG. 18 is an exploded view illustrating the actuator of the vacuum cleaner shown in FIG. 16. FIG. 19 is a control block diagram of the vacuum cleaner shown in FIG. 16.

With reference to FIGS. 16 to 19, the vacuum cleaner according to the fourth embodiment of the present invention will be described in below.

A vacuum cleaner 500 includes a main body 510 for generating a suction force and separating dust from air being sucked in, a suction nozzle unit 520 provided at a lower portion of the main body 510 to suck in air from a surface being cleaned, and multiple wheels 531 and 533, and may include a driving unit 530 for driving the main body 510, a handle unit 590 provided at an upper portion of the main body 510 to be relatively rotatable with respect thereto, and a control unit 580 for controlling the driving unit 530 on the basis of a relative rotational displacement of the handle unit 590 with respect to the main body 510 to enable the main body 510 to perform the active driving.

The main body 510 may include a fan motor (not shown) for generating the suction force and a dust collector 511 for separating the dust from the air being sucked in. The main body 510 is supported by the suction nozzle unit 520 to keep an upright state.

The suction nozzle unit 520 may contact with a surface being cleaned to suck in air thereon. The suction nozzle unit 520 may include a suction inlet (not shown) in which the air is sucked, a brush (not shown) for cleaning dust on the surface being cleaned, and a suction passage for guiding the air sucked in through the suction inlet to the dust collector.

The driving unit 530 may include the left wheel 531 and the right wheel 533 which are respectively provided at left and right sides of the main body 510, and a left wheel driving motor 532 and a right wheel driving motor 534 which drive the left wheel 531 and the right wheel 533, respectively. The left wheel 531 and the right wheel 533 may be independently driven. When the left wheel 531 and the right wheel 533 are simultaneously driven, the main body 510 may advance, whereas the main body 510 may rotate in place when only one of the left wheel 531 and the right wheel 533 is driven.

The handle unit 590 may be provided to be relatively rotatable with respect to the upper portion of the main body 510. Also, the handle unit 590 may be provided to be rotatable with respect to the main body 510 centering on at least one rotating shaft. Further, the handle unit 590 may be provided to be rotatable with respect to the main body 510 centering on multiple rotating shafts which are perpendicular to each other.

The handle unit 590 may have a coupling unit 592 coupled to an actuator 550 that will be described in below, and a grip unit 591 on which the user grips.

The actuator 550 may be provided between the handle unit 590 and the main body to mutually rotatably couple the handle unit 590 to the main body 510.

The actuator 550 may include the first rotating body 551 provided to be rotatable in the left and right directions centering on the X-axis, and the second rotating body 561 provided to be rotatable in the forward and backward directions centering on the Y-axis and coupled to the handle unit 590.

The first rotating body 551 may have an approximate doughnut shape and the second rotating body 561 may have an approximately hemispherical shape. The first rotating body 551 may be coupled to a supporting body 541. The supporting body 541 is a component that is fixed to the main body 510 so as to support the actuator 550. If a separate structure for supporting the actuator 550 is formed on the main body 510 in one unit, the supporting body 541 may be omitted.

In particular, the first rotating body 551 is coupled to the supporting body 541 to relatively rotate with respect thereto in the left and right directions centering on the X-axis. The second rotating body 561 is coupled to the first rotating body 551 to relatively rotate with respect thereto in the forward and backward directions centering on the Y-axis.

For this purpose, supporting shaft coupling holes 544 may be provided at the supporting body 541, and a supporting shaft 553, which is rotatably coupled to the supporting shaft coupling holes 544, may be provided at the first rotating body 551. The supporting shaft 553 is rotatably coupled to the supporting shaft coupling holes 544, such that the first rotating body 551 may relatively rotate with respect to the first supporting body 541 in the left and right directions centering on the X-axis.

A supporting shaft coupling hole 556 to which a supporting shaft 563 of the second rotating body 561 is rotatably coupled may be provided at the first rotating body 551. The supporting shaft 563 is rotatably coupled to the supporting shaft coupling hole 556, such that the second rotating body 561 may relatively rotate with respect to the first rotating body 551 in the forward and backward directions centering on the Y-axis.

The coupling unit 592 of the handle unit 590 may be coupled to a hollow 566 of the second rotating body 561 in a variety of manners. For example, the coupling unit 592 of the handle unit 590 may be fitted in and coupled to the hollow 566 of the second rotating body 561.

With such a configuration, the movement of the handle unit 590 centering on the Y-axis is delivered to the second rotating body 561 so that the second rotating body 561 rotates in the forward and backward directions centering on the Y-axis, whereas the movement of the handle unit 590 centering on the X-axis is delivered to the first rotating body 551 through the second rotating body 561 and the supporting shaft 563 so that the first rotating body 551 rotates in the left and right directions centering on the X-axis.

Multiple displacement sensors 557 and 567 may be provided at the vacuum cleaner 500 to detect a rotational displacement of the actuator 550. The multiple displacement sensors 557 and 567 may be potentiometers having sensor bodies 558 and 568 and adjustment knobs 559, 569 which are rotatably provided at the sensor bodies 558 and 568 to change resistance.

The first displacement sensor 557 may be coupled to the supporting body 541 to detect a rotational displacement of the first rotating body 551 with respect to the supporting body 541 in the left and right directions centering on the X-axis. For this purpose, the first sensor body 558 of the first displacement sensor 557 may be fixed to the supporting body 541, and the first adjustment knob 559 may be inserted into the first rotating body 551 to be rotated together therewith.

A first sensor body coupling recession 542 at which the first sensor body 558 is inserted into and fixed to, and a first adjustment knob through hole 543 through which the first adjustment knob 559 passes may be provided at the supporting body 541. A first adjustment knob inserting recession 552 into which the first adjustment knob 559 is inserted may be provided at the first rotating body 551.

The second displacement sensor 567 may be coupled to the first rotating body 551 to detect a rotational displacement of the second rotating body 561 with respect to the first rotating body 551 centering on the Y-axis.

For this purpose, the first sensor body 568 of the second displacement sensor 567 may be fixed to the first rotating body 551, and the second adjustment knob 569 may be inserted into the second rotating body 561 to be rotated together therewith.

Also, a second sensor body coupling recession 554 at which the second sensor body 568 is inserted into and fixed to, and a second adjustment knob through hole 555 through which the second adjustment knob 569 passes may be provided at the first rotating body 551. A second adjustment knob inserting recession 562 into which the second adjustment knob 569 is inserted may be provided at the second rotating body 561.

With such a configuration, when a rotational displacement of the handle unit 590 occurs, the occurred rotational displacement may be detected by the displacement sensors 557 and 567, the detected rotational displacement may be delivered to the control unit 580, and then the control unit 580 may control activation of the left wheel driving motor 532 and the right wheel driving motor 534 on the basis of the detected rotational displacement, thereby enabling the main body 510 to perform the active driving.

The vacuum cleaner 500 may further include elastic members 571 and 572 for elastically supporting the actuator 550. The elastic members 571 and 572 may restore a position of the actuator 550 when pressurizing the actuator 550 is released.

The elastic members 571 and 572 may include the first elastic members 571, each of which has one end being provided to be supported by the supporting body 541 and the other end being provided to be supported by the first rotating body 551, for elastically supporting the first rotating body 551, and the second elastic members 572, each of which has one end being provided to be supported by the supporting body 541 and the other end being provided to be supported by the second rotating body 561, for elastically supporting the second rotating body 561.

Spring supporters 545 for supporting the elastic members 571 and 572 may be provided at the supporting body 541. The elastic members 571 and 572 may be a compression coil spring.

An upper connector 546 and a lower connector 549 for fixing the supporting body 541 to the main body 510 may be provided at a lower portion of the supporting body 541, and a sealing member 548 for maintaining airtightness may be provided between the upper connector 546 and the lower connector 549.

The invention claimed is:

1. A vacuum cleaner, comprising:

a main body;

a suction nozzle configured to suck in air;

a suction hose configured to guide the air sucked in through the suction nozzle to the main body;

a wheel configured to rotate to move the main body;

a driving motor configured to provide a driving force to the wheel to rotate the wheel;

an actuator provided on the main body, connected to the suction hose, and including a first rotating body configured to rotate along a first rotation axis according to a movement of the suction hose, and a second rotating body configured to rotate along a second rotation axis according to the movement of the suction hose;

a vent unit provided inside the actuator to communicate with the suction hose;

a first displacement sensor configured to detect a rotational displacement of the first rotating body of the actuator along the first rotation axis;

a second displacement sensor configured to detect a rotational displacement of the second rotating body of the actuator along the second rotation axis; and a control unit configured to control the driving motor according to the detected rotational displacement of the first rotating body and the detected rotational displacement of the second rotating body so that the main body moves according to the movement of the suction hose, wherein the vent unit includes:

a first vent coupled to a lower portion of the second rotating body to communicate with the suction hose, and a second vent rotatably coupled to the first vent by a universal joint to communicate with the first vent.

2. The vacuum cleaner of claim 1, wherein the first rotating body is rotatable with respect to the main body along the first rotation axis, and the second rotating body is coupled between the first rotating body and the suction hose, and is rotatable with respect to the first rotating body along the second rotation axis.

3. The vacuum cleaner of claim 2, further comprising:

a supporting body fixed to the main body and coupled to the first rotating body to support the rotation of the first rotating body.

4. The vacuum cleaner of claim 3, wherein the first displacement sensor is a first potentiometer having a sensor body and an adjustment knob rotatably provided on the sensor body of the first potentiometer to change a resistance of the sensor body of the first potentiometer.

5. The vacuum cleaner of claim 4, wherein the sensor body of the first potentiometer is coupled to the supporting body, and the adjustment knob of the first potentiometer is inserted into the first rotating body to be rotated together with the first rotating body.

6. The vacuum cleaner of claim 4, wherein the second displacement sensor is a second potentiometer having a sensor body and an adjustment knob rotatably provided on the sensor body of the second potentiometer to change a resistance of the sensor body of the second potentiometer.

7. The vacuum cleaner of claim 6, wherein the sensor body of the second potentiometer is coupled to the first rotating body, and the adjustment knob of the second potentiometer is inserted into the second rotating body to be rotated together with the second rotating body.

8. The vacuum cleaner of claim 1, further comprising:

at least one elastic member configured to elastically support the actuator.

9. The vacuum cleaner of claim 1, further comprising:

an inner hose provided inside the actuator to communicate with the suction hose.

10. The vacuum cleaner of claim 1, wherein the second vent includes a bowl unit having a spherical outer circumferential surface, and the first vent includes a bowl housing configured to surround and support the bowl unit.

11. The vacuum cleaner of claim 1, wherein the actuator is provided at an upper portion of the main body, wherein a detected rotational displacement of the actuator includes the detected rotational displacement of the first rotating body and the detected rotational displacement of the second rotating body, and wherein:

when the suction hose is pulled in a forward direction of the main body, the detected rotational displacement of the actuator occurs in the forward direction and the control unit controls the driving motor to provide a driving force to the wheel to rotate the wheel to move the main body in the forward direction, when the suction hose is pulled in a left direction of the main body, the detected rotational displacement of the actuator occurs in the left direction and the control unit controls the driving motor to provide a driving force to the wheel to rotate the wheel to rotate the main body in the left direction, and when the suction hose is pulled in a right direction of the main body, the detected rotational displacement of the actuator occurs in the right direction and the control unit controls the driving motor to provide a driving force to the wheel to rotate the wheel to rotate the main body in the right direction.

12. The vacuum cleaner of claim 1, wherein the actuator is provided at a front portion of the main body, wherein a detected rotational displacement of the actuator includes the detected rotational displacement of the first rotating body and the detected rotational displacement of the second rotating body, and wherein:

when the suction hose is pulled in a forward direction of the main body, the detected rotational displacement of the actuator occurs in the forward direction and the control unit controls the driving motor to provide a driving force to the wheel to rotate the wheel to move the main body in the forward direction, when the suction hose is pulled in a left direction of the main body, the detected rotational displacement of the actuator occurs in the left direction and the control unit controls the driving motor to provide a driving force to the wheel to rotate the wheel to rotate the main body in the left direction, and when the suction hose is pulled in a right direction of the main body, the detected rotational displacement of the actuator occurs in the right direction and the control unit controls the driving motor to provide a driving force to the wheel to rotate the wheel to rotate the main body in the right direction.

13. A vacuum cleaner, comprising:

a main body;

a plurality of wheels provided at both sides of the main body;

a plurality of driving motors configured to provide the plurality of wheels with driving forces;

a plurality of reduction gears configured to deliver the driving forces of the plurality of driving motors to the plurality of wheels;

an actuator configured to rotate in left and right directions centering on a first rotation axis or in forward and backward directions centering on a second rotation axis;

a first displacement sensor configured to detect rotational displacement of the actuator in the left and right directions;

a second displacement sensor configured to detect rotational displacement of the actuator in the forward and backward directions; and multiple clutches configured to intermit power transmission by connecting or disconnecting the plurality of reduction gears and the plurality of wheels, wherein the vacuum cleaner has an active driving mode in which the multiple clutches are connected and a manual driving mode in which the multiple clutches are disconnected.

14. The vacuum cleaner of claim 13, wherein the plurality of driving motors are activated according to rotation of the actuator in the active driving mode to enable the main body to actively advance or rotate in the left and right directions.

15. The vacuum cleaner of claim 13, wherein the plurality of wheels idly rotate in the manual driving mode without interfering with loads of the plurality of driving motors and the plurality of reduction gears.

16. A vacuum cleaner, comprising:

a main body configured to generate a suction force and to separate dust from air being sucked in;

a suction nozzle unit provided at a lower portion of the main body to suck in air;

a driving unit configured to drive the main body;

a handle unit provided at an upper portion of the main body to be rotatable with respect to the main body;

an actuator including a first rotating body configured to rotate along a first rotation axis according to a movement of the handle unit, a second rotating body configured to rotate along a second rotation axis according to the movement of the handle unit, and a displacement sensor configured to detect a rotational displacement of the actuator, wherein the rotational displacement of the actuator includes a rotational displacement of first rotating body along the first rotation axis and a rotational displacement of the second rotating body along the second rotation axis;

a vent unit provided inside the actuator to communicate with the handle unit; and a control unit configured to control the driving unit on the basis of the rotational displacement of the actuator, wherein the vent unit includes:

a first vent coupled to a lower portion of the second rotating body to communicate with the handle unit, and a second vent rotatably coupled to the first vent by a universal joint to communicate with the first vent.

17. The vacuum cleaner of claim 16, wherein the first rotation axis is perpendicular to the second rotation axis.

18. The vacuum cleaner of claim 16, wherein the actuator is provided between the main body and the handle unit to rotatably couple the main body to the handle unit so that the displacement sensor is configured to detect a rotational displacement of the handle unit with respect to the main body.

* * * * *